US008545641B2

(12) United States Patent
Sagawa et al.

(10) Patent No.: US 8,545,641 B2
(45) Date of Patent: Oct. 1, 2013

(54) METHOD AND SYSTEM FOR MANUFACTURING SINTERED RARE-EARTH MAGNET HAVING MAGNETIC ANISOTROPY

(75) Inventors: Masato Sagawa, Kyoto (JP); Hiroshi Nagata, Kyoto (JP); Osamu Itatani, Kyoto (JP)

(73) Assignee: Intermetallics Co., Ltd., Kyoto (JP)

( * ) Notice: Subject to any disclaimer, the term of this patent is extended or adjusted under 35 U.S.C. 154(b) by 613 days.

(21) Appl. No.: 11/630,898

(22) PCT Filed: Jun. 30, 2005

(86) PCT No.: PCT/JP2005/012123

§ 371 (c)(1),
(2), (4) Date: Dec. 27, 2006

(87) PCT Pub. No.: WO2006/004014

PCT Pub. Date: Jan. 12, 2006

(65) Prior Publication Data

US 2007/0245851 A1 Oct. 25, 2007

(30) Foreign Application Priority Data

Jul. 1, 2004 (JP) ..... 2004-195935

(51) Int. Cl.
*H01F 1/057* (2006.01)

(52) U.S. Cl.
USPC ..... 148/103; 75/244; 148/302; 419/12

(58) Field of Classification Search
USPC ..... 148/103, 300–302; 419/12; 75/244
See application file for complete search history.

(56) References Cited

U.S. PATENT DOCUMENTS

| | | | |
|---|---|---|---|
| 2,762,777 | A | 9/1956 | Went et al. |
| 2,762,778 | A | 9/1956 | Gorter et al. |
| 3,684,593 | A | 8/1972 | Benz et al. |

(Continued)

FOREIGN PATENT DOCUMENTS

| | | |
|---|---|---|
| JP | S 35-8281 | 4/1951 |
| JP | S 29-885 | 12/1951 |

(Continued)

OTHER PUBLICATIONS

Harris, "Monocrystalline powder processing," Rare-earth Iron Permanent Magnets, Edited by J.M.D. Coey, Trinity College, Clarendon Press, Oxford, pp. 340-341, 1996.

(Continued)

*Primary Examiner* — Roy King
*Assistant Examiner* — Timothy Haug
(74) *Attorney, Agent, or Firm* — Oliff & Berridge, PLC

(57) ABSTRACT

A method for manufacturing a sintered rare-earth magnet having a magnetic anisotropy, in which a very active powder having a small grain size can be safely used in a low-oxidized state. A fine powder as a material of the sintered rare-earth magnet having a magnetic anisotropy is loaded into a mold until its density reaches a predetermined level. Then, in a magnetic orientation section, the fine powder is oriented by a pulsed magnetic field. Subsequently, the fine powder is not compressed but immediately sintered in a sintering furnace. A multi-cavity mold for manufacturing a sintered rare-earth magnet having an industrially important shape, such as a plate magnet or an arched plate magnet, may be used.

42 Claims, 7 Drawing Sheets

(56) References Cited

U.S. PATENT DOCUMENTS

| | | | | |
|---|---|---|---|---|
| 4,792,367 | A | 12/1988 | Lee | |
| 5,004,580 | A * | 4/1991 | Matsuo et al. | 419/65 |
| 5,250,255 | A | 10/1993 | Sagawa et al. | |
| 5,672,363 | A | 9/1997 | Sagawa et al. | |
| 2002/0159909 | A1 | 10/2002 | Oota et al. | |
| 2004/0241033 | A1 | 12/2004 | Ogawa et al. | |
| 2005/0076973 | A1 * | 4/2005 | Masuzawa et al. | 148/104 |

FOREIGN PATENT DOCUMENTS

| | | |
|---|---|---|
| JP | A-55-096616 | 7/1980 |
| JP | A 59-46008 | 3/1984 |
| JP | A 59-89401 | 5/1984 |
| JP | A 59-163802 | 9/1984 |
| JP | A 60-32306 | 2/1985 |
| JP | A 60-63304 | 4/1985 |
| JP | A 60-182104 | 9/1985 |
| JP | A-61-044414 | 3/1986 |
| JP | A 63-33505 | 2/1988 |
| JP | A 63-317643 | 12/1988 |
| JP | A 2-3903 | 1/1990 |
| JP | A 2-250922 | 10/1990 |
| JP | A 3-224203 | 10/1991 |
| JP | A 4-363010 | 12/1992 |
| JP | A 5-234789 | 9/1993 |
| JP | A 6-96973 | 4/1994 |
| JP | A 6-108104 | 4/1994 |
| JP | A 6-322469 | 11/1994 |
| JP | A 7-57914 | 3/1995 |
| JP | A 7-153612 | 6/1995 |
| JP | A 8-111308 | 4/1996 |
| JP | A 8-167515 | 6/1996 |
| JP | A 8-167516 | 6/1996 |
| JP | A 9-70696 | 3/1997 |
| JP | A 9-78103 | 3/1997 |
| JP | A 9-169301 | 6/1997 |
| JP | A 11-49101 | 2/1999 |
| JP | A 2000-96104 | 4/2000 |
| JP | A 2000-109903 | 4/2000 |
| JP | A 2000-306753 | 11/2000 |
| JP | A 2001-28309 | 1/2001 |
| JP | A-2001-323301 | 11/2001 |
| JP | A-2002-008935 | 1/2002 |
| JP | A-2002-088403 | 3/2002 |
| JP | A-2002-160096 | 6/2002 |
| JP | A-2002-170728 | 6/2002 |
| JP | A 2002-208509 | 7/2002 |
| JP | A-2003-166001 | 6/2003 |
| JP | A 2004-2998 | 1/2004 |

OTHER PUBLICATIONS

Ormerod, "Powder metallurgy of rare earth permanent magnets," Powder Metallurgy, vol. 32, No. 4, pp. 244-249, 1989.

Dec. 16, 2010 Office Action issued in European Patent Application No. 05 765 338.8.

Jun. 14, 2010 Supplementary European Search Report issued in European Patent Application No. 05 765 338.8.

Oct. 25, 2011 Office Action issued in Taiwanese Application No. 94122355 (with translation).

Feb. 8, 2012 Korean Office Action issued in Korean Application No. 10-2007-7000697 with English-language translation.

* cited by examiner

METHOD AND SYSTEM FOR MANUFACTURING SINTERED RARE-EARTH MAGNET HAVING MAGNETIC ANISOTROPY

TECHNICAL FIELD

The present invention relates to a method for manufacturing a high-performance rare-earth magnet and a system for the method.

BACKGROUND ART

A sintered rare-earth/iron/boron magnet, which is called "RFeB magnet" hereinafter, was introduced in 1982 and is steadily spreading their fields of commercial application as ideal materials for permanent magnets. They can be produced at low costs from neodymium, iron, boron and other materials abundantly present in nature. Moreover, their characteristics are much better than those of their predecessors. The major application areas of the RFeB magnets are: voice coil motors (VCMs) for actuating magnetic heads of hard disk drives (HDDs) used in computers; high-quality speakers; headphones; battery-assisted bicycles; golf carts; and magnetic resonance imaging (MRI) apparatuses using permanent magnets. They are also coming into practical use in drive motors for hybrid cars.

The RFeB magnet was discovered by the present inventors (see Patent Document 1) in 1982. Its main phase consists of a magnetically anisotropic, intermetallic compound of $R_2Fe_{14}B$ having a tetragonal crystal structure. To obtain high magnetic characteristics, it is necessary to utilize a magnetic anisotropy. In addition to sintering, several methods have been proposed. For example, Japanese Patent No. 2561704 discloses a method including the steps of casting, hot working and aging treatment. Another method disclosed in U.S. Pat. No. 4,792,367 has the step of die upsetting of a quenched alloy. However, these methods are inferior to the sintering method with respect to both the magnetic characteristics and productivity. Sintering is the best method for obtaining a dense and uniform microstructure that is indispensable for permanent magnets.

[Manufacturing Process]

The process of manufacturing a sintered RFeB magnet includes the following steps: composition determination, dissolution, casting, pulverization, compression molding in a magnetic field, sintering, and heat treatment.

[Composition]

Since the discovery of the RFeB magnet, many techniques for improving the coercive force and other characteristics of the magnet have been invented, focusing on the effects of additional elements (e.g. Japanese Patent No. 1606420), heat treatments (e.g. Japanese Patent No. 1818977), and control of the crystal grain size (e.g. Japanese Patent No. 1662257). The most effective technique for enhancing the coercive force is the addition of heavy rare-earth elements (Dy and Tb) (Japanese Patent No. 1802487). Use of a large amount of heavy rare-earth elements assuredly improves the coercive force. However, it also lowers the saturation magnetization and accordingly decreases the maximum energy product. Furthermore, both Dy and Tb are rarely found in nature and also expensive, so that these elements cannot be used to produce motors for hybrid cars, which will gain more commercial demand in the future, or other industrial or domestic motors.

[Resolution]

Sintered magnets need to have a dense, uniform microstructure. In earlier years, they were typically manufactured by casting a molten alloy and pulverizing the cast alloy (e.g. Japanese Patent No. 1431617). Quenching the molten alloy by a strip-casting method suppresses the formation of alpha iron. This reduces the amount of nonmagnetic rare-earth elements and thereby increases the energy product (e.g. Japanese Patent No. 2665590 and Unexamined Japanese Patent Publication No. 2002-208509).

[Pulverization]

An RFeB alloy becomes easier to pulverize when it occludes hydrogen, because the hydrogen creates microcracks within the alloy (Japanese Patent No. 1675022). The most popular pulverization method is a jet-mill pulverization that uses an inert gas, such as nitrogen (e.g. Japanese Patent No. 1883860). This technique produces a powder whose grain-size distribution has a sharp peak.

[Molding]

The technique of creating a sintered magnet having a magnetic anisotropy by compression molding of a powder in a magnetic field was initially adopted in the invention of a ferrite magnet (Examined Japanese Patent Publication No. S29-885 or U.S. Pat. No. 2,762,778) and later applied to the production of RCo or RFeB magnets (U.S. Pat. No. 3,684,593 or Japanese Patent No. 1431617). The fine particles of the powder are compacted into a body in which their c-axes of the RFeB tetragonal crystal structure are oriented to the same direction. A typical technique is the die-pressing method. Other methods include the CIP method (Japanese Patent No. 3383448) and the RIP method (Japanese Patent No. 2030923), both of which provide higher degrees of orientation and larger energy products.

[Die-Pressing Method]

In 1951, when Went et al. invented a ferrite magnet (Examined Japanese Patent No. S35-8281 and U.S. Pat. No. 2,762,777), Gorter et al. also invented a sintered ferrite magnet having a magnetic anisotropy (Examined Japanese Patent No. S29-885 and U.S. Pat. No. 2,762,778). This was the first case where the compression molding in a magnetic field was combined with a sintering process to manufacture a permanent magnet having a magnetic anisotropy. Since then, various improvements have been made to overcome the problems discerned in the mould-pressing method.

[Addition of a Lubricant]

In some methods, a lubricant is added to increase the degree of orientation of the fine particles during the die-pressing process and to reduce the friction among and between the particles and the die (e.g. Japanese Patent Nos. 2545603 and 3459477).

[Wet Pressing in a Magnetic Field]

To achieve a high degree of orientation while preventing the fine particles from oxidization, some methods include the steps of mixing the fine particles with a mineral oil, a synthetic oil or a vegetable oil, injecting the mixture into the die with a high pressure, and performing a wet compression molding in a magnetic field (e.g. Japanese Patent No. 2731337). Some reports on this technique claim that the magnetic characteristics can be improved by pressure injection and pressure compression of slurry (Japanese Patent No. 2859517).

[CIP]

The die-pressing method can apply the pressure only in one direction, which leads to misorientation. An isotropic application of pressure from every direction will reduce the disorder of the orientation. In one method for the isotropic application of the pressure, a rubber container filled with the fine particles is set in an external magnetic field and subjected to a cold isostatic pressing (CIP) process (Japanese Patent No. 3383448).

[RIP]

To obtain the same effect as the CIP method, the present inventors proposed the rubber isostatic pressing (RIP) method, in which a rubber mold is set in a die-pressing machine and subjected to an isostatic pressure (Japanese Patent No. 2030923). This method is easier to automate and hence far more suitable for mass production than the CIP method.

[AT]

An air-tapping [AT] method, which was proposed in Unexamined Japanese Patent Publication Nos. H09-78103, H09-169301 and H11-49101, is a method for loading a cohesive fine powder into the die cavity of a die-pressing machine or similar machines. In this technique, a rapid flow of air is intermittently supplied onto a powder to uniformly load it into the die cavity with high density. In a method proposed in Unexamined Japanese Patent No. 2000-96104, the air-tapping technique is used to solidify the powder into an object having a near net shape.

[Pulsed Magnetic Field]

A magnetic field is externally applied to the particles in order to orient them in the same direction. In the case of RFeB magnets, the c-axis of the tetragonal crystal structure corresponds to the easy magnetization axis. When the magnetic field is applied, the particles are oriented in the axial direction. Normal types of die-pressing machines use an electromagnet to create a static magnetic field, whose maximum field strength is about 15 kOe. In contrast, in the case of creating a pulsed magnetic field with an air core coil, the field strength can be as high as 15 to 55 kOe. Use of such a strong magnetic field actually improves the magnetic characteristics (Japanese Patent No. 3307418).

[Closed System]

In a method proposed in Unexamined Japanese Patent Publication No. H06-108104, the pulverization and molding processes are performed under inert atmosphere in order to avoid the powder oxidization.

[Patent Document 1] Japanese Patent No. 1431617

DISCLOSURE OF THE INVENTION

Problem to be Solved by the Invention

[Effect of the Sintering Method]

A powder metallurgy (or sintering) method can create a dense and uniform microstructure. As far as rare-earth cobalt magnets and RFeB magnets are concerned, the powder metallurgy is the best technique to utilize the characteristics of each material and obtain a high-performance permanent magnet.

[Press-Molding in a Magnetic Field]

The first case where the compression molding in a magnetic field was combined with the sintering process to produce a sintered magnet having a magnetic anisotropy was the invention of a sintered ferrite magnet having a magnetic anisotropy by Gorter et al. (Examined Japanese Patent No. S29-885 and U.S. Pat. No. 2,762,778). It was immediately after the invention of a ferrite magnet by Went et al. in 1951 (Examined Japanese Patent No. S35-8281 and U.S. Pat. No. 2,762,777). The alleged purposes of the compression molding are to squeeze liquid components by a compression process and to fix the oriented state of the particles. It is also claimed that the compression molding is a good technique to obtain a desired shape. An experiment has proved that, if a powder is put in a container and heated in a magnetic field without being compressed, the resultant product has a lower density and poorer magnetic characteristics than the product obtained by the compression molding.

Later, the technique of the compression molding combined with the sintering process was further applied to the production of sintered RCo magnets (U.S. Pat. No. 3,684,593) and sintered RFeB magnets (Japanese Patent No. 1431617). Applying a magnetic field is an essential process to orient the particles. However, the effect of compression has not been particularly examined.

[Reason for Choosing a Die-Pressing Method]

The die-pressing method is used because it can create a "net shape" that is close to the final product in shape and size, and is an automated process with a high yield percentage. Particularly, the net shape and the yield percentage are the key features that have made the die-pressing method widely used as a suitable technique for mass production.

[RIP]

To obtain the same effect as comparable to the CIP method, the present inventors proposed the rubber isostatic pressing (RIP) method (Japanese Patent No. 2030923). In this method, a fine powder is put into a rubber mold, and the entire mold is pressed by a die-pressing machine while a pulsed magnetic field is applied. The combination of the CIP-like isotropic pressure with the pulsed magnetic field enables the RIP method to give the magnet higher characteristics than cannot be achieved by die-pressing. An RIP process includes the steps of filling the rubber mold, applying the pulsed magnetic field, performing the compression molding and demagnetization. These sequential steps can be automated for mass production.

[Detailed Steps of Pressing in a Magnetic Field]

During the long history of the die-pressing technique, many attempts have been made to automate the process and thereby improve the working efficiency. The process typically includes the following steps:

- A fine powder is supplied through the feeder into a die.
- The upper punch is lowered to close the cavity.
- A magnetic field is applied.
- While the magnetic field is applied, the powder is pressed with the upper and lower punches.
- A demagnetizing or alternating field is applied to demagnetize the powder compact.
- The upper punch is lifted.
- The lower punch is lifted (or the die is lowered) to push the powder compact out of the top of the die.
- A robot arm transfers the powder compact onto the conveyer.
- The powder compacts are gathered to a specific area.
- The powder compacts are arranged on a sintering bedplate.

The powder compacts are arranged at certain intervals so that they do not collide with or adhere to each other. Under some working conditions, the powder compacts may be stored for a few days. Die-pressing machines used in the powder metallurgy are precision machines; though the positioning of the punches and the dies is relatively easy if a single-cavity die is used, the positioning operation will be complex if the die has multiple cavities. There are various forms and sizes of magnets demanded: disc, rectangle, ring, arc and so on. It is necessary to carry out a troublesome work for exchanging dies every time the form or size is changed.

[Purpose and Effect of the Compression Molding in a Magnetic Field]

With respect to the function of the compression molding, there is an explanation in a book entitled *Rare-earth Iron Permanent Magnet*, edited by J. M. D. Coey, CLARENDON PRESS, OXFORD, 1996, pp. 340-341: "The pressing load is sufficient to make compacts having enough strength to be handled but without significant misorientation of the crystallites." J. Ormerod wrote in his paper entitled "Powder Metallurgy of rare earth permanent magnets", *Powder Metallurgy* 1989, Vol. 32, No. 4, p. 247: "The pressing pressure should be sufficient to give the powder compact enough mechanical strength to withstand handling, but not high enough to cause particle misorientation." Both accounts stress that it is necessary to strongly compress the powder compact to make it strong enough for handling, while recognizing the possibility of misorientation that will occur if the pressure is too strong.

[Problems Inherent in Rare-Earth Magnets]

A rare-earth magnet contains about 30 weight percent of rare-earth element/rare-earth elements, which is/are chemically active and easy to oxidize. A process of manufacturing a sintered rare-earth magnet includes a step that handles fine particles having a grain size of about 3 μm and containing a large amount of chemically active rare-earth element. Every particle of the fine powder needs to be oriented in the same direction in the magnetic field. Therefore, it is impossible to preliminarily granulate the powder for improving its fluidity, as in normal cases of powder metallurgy. Since the fine powder is used in volume and each particle behaves as a magnet, the powder forms a bridge when it is supplied into the die cavity. Thus, it is difficult to uniformly load the powder.

[For Better Orientation]

In the methods proposed in Japanese Patent No. 3459477, Unexamined Japanese Patent Publication No. H08-167515 and so on, a lubricant is added to increase the degree of orientation of the fine powder during the die-pressing process. The lubricant reduces the friction among the fine particles and thereby improves their degree of orientation while they are being compressed in the magnetic field. However, adding too much lubricant to obtain an adequate lubricating effect results in a longer period of time required for degreasing. A certain kind of liquid lubricant (e.g. one disclosed in Unexamined Japanese Patent Publication No. 2000-306753) is known for its good volatility and said to scarcely remain in the sintered body. However, adding too much lubricant to increase the degree of orientation decreases the strength of the powder compact after the die-pressing process, causing a problem in handling. Die-pressing machines use an electromagnet to apply a static magnetic field. The maximum strength of the static magnetic field created by the electromagnet is limited to about 10 to 15 kOe (1 to 1.5 T) because the magnetic flux saturates due to the iron core. With this magnetic field unchanged, if the pressure is increased, the frictional force among the particles will be stronger than the magnetic force, causing each particle to rotate. Thus, a misorientation takes place. To prevent this phenomenon, a method of orientation that uses a pulsed magnetic field has been proposed (Japanese Patent No. 3307418). It has been confirmed that the pulsed magnetic field can achieve the strength of 1.5 to 5.5 T and thereby enhance $B_r$, the residual magnetic flux density. However, if a pulsed magnetic field is created within a die-pressing machine as in the above invention, an eddy-current loss or a hysteresis loss takes place every time the magnetic field is applied, causing the die to generate heat. Furthermore, the pulsed magnetic field impacts the metallic die in a moment and shortens the life of the pressing machine, which is precisely constructed. Thus, the above method is impractical.

[To Make the Powder Compact Stronger]

To improve the workability of the die-pressing process, some conventional methods add an organic binder or a lubricant, while others adopt a wet molding technique. However, these methods all presuppose the use of a strong compression force. Therefore, the aforementioned additives are firmly confined within the powder compact, so that they cannot be removed by a degreasing process performed before the sintering process. Heating the powder compact at a low temperature for a long period of time could completely remove the additives. However, this approach would significantly lower the productivity. If the powder compact with the organic component remaining inside is heated at too high a temperature, the regular elements will react with carbon and other impurities, causing the magnetic characteristics to deteriorate and the corrosion resistance to be lower.

[Wet Molding]

To achieve a high degree of orientation while preventing the oxidization of the fine powder, one conventional method mixes the fine particles with a mineral oil or a synthetic oil and then shapes the mixture by a wet compression molding in a magnetic field (e.g. Japanese Patent No. 2859517). In this method, a fine powder obtained by a pulverization process using a jet mill is collected in and mixed with a mineral or synthetic oil, and the mixture is injected into and compressed within the die cavity by pressure. Wet molding is a variation of the manufacturing technique of Sr ferrite magnets. The difference exists in that water is used for ferrite magnets while rare-earth magnets do not allow the use of water, instead of which an oil or other solvent is used. Oils contain a large amount of impurities, such as carbon, which are difficult to remove through the sintering process. Although researchers are attempting to invent new kinds of oil that easily vaporize and leave virtually no remnants, it is difficult to remove carbon once it is confined in a tightly compressed powder compact. Such a degreasing process needs to be performed at a temperature where the oil vaporizes and does not react with the rare earth. For that purpose, it is necessary to maintain the powder compact at a relatively low temperature for a long period of time, which significantly deteriorates the mass production efficiency. If the degreasing is not fully performed, the remaining elements easily react with the rare-earth elements at high temperatures, which deteriorates the magnetic characteristics and reduces the corrosion resistance.

[Oxygen-Free Process]

In the die-pressing method, the fine powder is exposed to air. In a method proposed in Unexamined Japanese Patent Publication No. H06-108104, the steps from the pressing in a magnetic field to the conveying into the sintering furnace are carried out under inert atmosphere. However, in practice, it is necessary to remove the fine particles scattered around the die and frequently exchange the dies; opening the chamber with the particles scattered inside is dangerous. Since the magnetic fine powder is used in volume and liable to form a bridge, it is difficult to constantly feed the powder. Therefore, it is necessary to regularly weigh the powder compact and give a feed back about the result. As opposed to normal crystals, rare-earth magnets do not allow a large amount of binder and a high pressure to be used to create a robust powder compact. Therefore, the resultant powder compact is fragile. Using a glove box or similar tools that allow operators to insert their hands into the pressing machine and do some tasks is dangerous and inefficient. In summary, it can be said that the idea of setting the entire manufacturing system, including the die-pressing machine, under inert atmosphere is very difficult to realize on a mass production basis.

[Why Fine Powders have not been Used]

Confining fine particles having a grain size of 3 μm is impracticable even if the dies and punches have the narrowest possible clearance. Therefore, every time the fine powder is compressed, a portion of the fine particles will be ejected and fly around the die. Such particles have a potential for ignition or explosion. These particles can be collected with an automatic dust collector. In that case, however, the apparatus needs to be regularly cleaned. For magnet makers having the most advanced techniques in the world, the crystal grain size of the sintered RFeB magnets used in mass production is from 4.5 to 6 μm in terms of $D_{50}$, i.e. the median of the grain size measured with a laser-type grain-size distribution measurement apparatus. It is known that the $D_{50}$ value is approximate to the actual grain size measured with a microscope. The size of a single-domain particle of the intermetallic compound $R_2Fe_{14}B$ is much smaller (0.2 to 0.5 μm). Therefore, in the case of sintered magnets, it is expected that a smaller crystal grain size will result in a stronger coercive force. In fact, however, the coercive force rapidly falls with the decrease of the grain size, as shown in FIG. 3 of Unexamined Japanese Patent Publication No. S59-163802. This fact suggests that oxidization is unavoidable in the conventional processes that handle a fine powder. An RFeB alloy powder, which contains a chemically active rare-earth element, is very easy to oxidize and may ignite if it is left under atmosphere. The danger of ignition is larger as the grain size is smaller. Even if it does not ignite, the powder is easily oxidized to a nonmagnetic oxide, which will remain in the sintered magnet and deteriorate its magnetic characteristics. However, in the conventional methods, it is unavoidable that the fine powder is exposed to air during the molding process and when the powder compact is conveyed into the sintering furnace. As stated earlier, the grain size of the fine particles produced by the world-class makers is about 4.5 to 6 μm in $D_{50}$; any powder finer than this level will easily oxidize even after it is compressed into a compact. In some previous attempts, an oil or a liquid lubricant is added to the fine powder to obtain a synergistic effect for preventing the oxidization. However, adding a large amount of lubricant or similar material not only weakens the powder compact but also leaves carbon or other impurities, which deteriorate the magnetic characteristics. In summary, it is practically impossible to use a powder whose $D_{50}$ is 4 μm or smaller in the conventional die-pressing method.

As explained earlier, the most serious problem relating to the method and system for manufacturing a sintered RFeB magnet is that it is difficult to construct the manufacturing line as a perfectly closed system. It is known that the characteristics of a sintered RFeB magnet become higher as the grain size is smaller or as the powder or the powder compact is less oxidized during the manufacturing process. However, the powder becomes more active as its surface is less oxidized or its grain size is smaller. To handle such an active powder, it is necessary to always fill the manufacturing line with an inert gas, such as $N_2$. Even the smallest amount of air intrusion will cause the powder to generate heat. Since the amount of the powder handled in a mass production line is very large, the small amount of heat can increase and eventually cause a fire. Currently, most of the sintered RFeB magnets having a magnetic anisotropy are produced through a manufacturing line that employs either the die-pressing method or the RIP method. A portion of this manufacturing line is designed to be operated with its inner space filled with an inert gas. Sintered RFeB magnets having a magnetic anisotropy produced by such a manufacturing line have high characteristics because they are less oxidized. However, such a low-oxygen production line is not perfectly free from the danger of fire, explosion or similar serious accidents. Therefore, it is difficult to make the powder more active than the current level, even if it is known that use of such a powder will further improve the characteristics. The reasons why it is difficult to construct the current manufacturing lines as a perfectly closed system are as follows:

A manufacturing line employing the die-pressing method:

(1) The space to be enclosed is very large.

(2) It is difficult to exchange a large die while preventing air from intruding into the system.

(3) To improve the productivity, it is necessary to sequentially perform the following steps at short cycles of time: loading and compressing the powder, taking out the powder compact, cleaning the powder compact (i.e. removing unnecessary powder from the surface), arranging the powder compact on a bedplate, boxing up the bedplate with powder compacts on it, and setting the box with the powder compacts into the sintering furnace. In practice, various problems often take place during these steps. Solving such problems always requires some manual operation, and it often happens that these cannot be solved without introducing air into the system.

A manufacturing line employing the RIP method:

To improve the productivity, it is necessary to sequentially perform the following steps at short cycles of time: loading a powder into the rubber mold with high density, orienting the powder by a magnetic field, compressing the powder, taking out the powder compact, cleaning the powder compact, arranging the powder compact on a bedplate, boxing up the bedplate with powder compacts on it, and setting the box with the powder compacts into the sintering furnace. This process often encounters many problems, some of which cannot be solved without introducing air into the system, as in the case of the manufacturing line employing the die-pressing method.

In the above two types of manufacturing lines, the primary reason why the system cannot be a perfectly closed system is that it is necessary to take out the powder compact from the die or rubber mold after the powder-compressing step. In the course of taking out the powder compact from the die or rubber mold, the powder compact may be cracked or chipped, or unnecessary powder may stick to it. Similarly, the cracking or chipping of the powder compact can occur during the subsequent handling operations. Since robots cannot deal with such accidents, it is necessary to introduce air into the system so that the operator can manually solve the problem. Thus, the aforementioned manufacturing lines can work as a closed system for producing RFeB-based anisotropic sintered magnets only on a temporary basis; it is very difficult to continue the operation for a long period of time. Use of a powder that is more active than those currently used will not be accepted by those who are working on site; it is actually very dangerous.

As described thus far, the conventional methods for manufacturing a sintered RFeB magnet having a magnetic anisotropy, using either the die-pressing method or the RIP method, are inappropriate for handling an active powder. This means that, on a mass production basis, those methods have only a limited range for reducing the grain size or lowering the amount of oxygen contained in the powder in order to improve the magnetic characteristics, and particularly the coercive force, of the magnets. Even in the production of the highest-quality RFeB magnets by world-class makers, the grain size of powder used in the conventional methods is about 5 μm in $D_{50}$, i.e. the median of the grain-size distribution measured by a laser-type grain-size distribution measurement method.

Another problem of the method for manufacturing a sintered RFeB magnet having a magnetic anisotropy is that its productivity declines if the magnet is a plate type or an arched plate type. These types occupy a large percentage of all the sintered RFeB magnets having a magnetic anisotropy. In these types of magnets, the magnetizing direction is perpendicular to the main surface of the magnet.

One conventional method for manufacturing a plate magnet is to slice a large block of sintered magnet with a cutter having a peripheral cutting edge. One shortcoming of this method is that a portion of the expensive sintered magnet is chipped off and wasted. The percentage of the wasted portion increases as the product becomes thinner. Another problem is that the process requires a long machining (cutting) time and causes heavy abrasion of the tools used.

Another method for manufacturing a plate magnet is to create powder compacts by a die-pressing method in a magnetic field on a piece-by-piece basis and then separately sinter each piece of the plate magnet. One shortcoming of this method is that the plate magnet needs to be formed by applying a pressure parallel to the magnetic field. Applying the pressure in this manner causes the misorientation of the powder during the compression process, which causes the maximum energy product of the resultant, sintered magnet to be nearly 10 MGOe lower than that of the magnet created by applying a pressure perpendicular to the magnetic field. Furthermore, the piece-by-piece pressing and sintering of the plate magnet is unproductive. It is possible to adopt a multi-cavity pressing method, which uses multiple die cavities to create or sinter multiple powder compacts. However, the number of powder compacts that can be simultaneously created is about two to four at most due to the restriction on the pressure to be applied. Thus, this method does not significantly improve the productivity.

When an arched plate magnet is produced by a conventional method, the pressure is applied in the direction parallel to the magnetic field. This method also has the same problems as described previously in connection with the manufacturing of plate magnets. That is, the maximum energy product of the magnet is low due to the low degree of orientation of the magnet after the sintering. Also, the process from the molding to the sintering is unproductive, irrespective of whether each magnet is separately created or a multi-cavity molding method using multiple die cavities is adopted.

In the case of manufacturing arched plate magnets by a conventional method, applying a pressure perpendicular to the magnetic field leads to an increase in the maximum energy product of the sintered magnet. However, the problem of the low productivity still remains. Another problem is that this method limits the height of the powder compact shaped like an arched plate.

Still another problem of the conventional manufacturing methods is that they cannot produce a long-size sintered body having a circular or irregular cross-section. In the die-pressing method, applying a pressure parallel to the magnetic field restricts the allowable range of the length (or height) of the powder compact and lowers the maximum energy product of the magnet obtained. In contrast, applying a pressure perpendicular to the magnetic field to create a long object restricts the cross-section of the powder compact that can be formed, so that it is impossible to obtain a near net shape.

Still another shortcoming of the conventional production methods is that it is difficult to create a ring-shaped flat magnet having high characteristics. Ring-shaped flat magnets must be magnetized in the direction perpendicular to the disc surface. Ring-shaped flat magnets are created by applying a pressure parallel to the magnetic field. However, the maximum energy product of the magnets created by this method is nearly 10 MGOe lower than that obtained by a method that applies a pressure perpendicular to the magnetic field. The RIP method, which was initially expected as a method for producing ring-shaped flat magnets having high characteristics, is not currently used for the production of the ring-shaped flat magnets due to some problems, such as the distortion of the shape during the molding process.

Still another problem of the conventional methods is that they cannot directly sinter a small-size powder compact to create an accordingly small type of sintered magnet, such as a thin plate magnet having a thickness of 1 mm or smaller or a long-size sintered magnet having a circular or irregular cross-section measuring 1 mm in diameter or on one side. This is partly because such a small-size powder compact cannot be created by a die-pressing method or an RIP method, and partly because it is difficult to handle the resultant small-size powder compacts without breaking them in the course of arranging them on a bedplate, boxing them up and setting them into the sintering furnace. The metal injection method (MIM) is known as a method available for such a case. However, this method is not popular in the production of RFeB-based anisotropic sintered magnets due to some problems, such as residual carbon impurities.

[Objectives of the Invention]

In the field of the method and system for manufacturing a sintered rare-earth magnet having a magnetic anisotropy, the objectives of the present invention are to resolve fundamental problems relating to the current methods and systems for manufacturing a sintered magnet employing a die-pressing method and an RIP method, in order to create sintered RFeB magnets having a higher maximum energy product and a higher coercive force; to improve the efficiency of producing plate magnets and arched plate magnets; to provide a means for creating ring-shaped magnets having a high degree of orientation; and to provide a means for creating long-size sintered bodies having a circular or irregular cross-section and small-size sintered bodies measuring 1 mm or smaller.

Means for Solving the Problems

To solve the problems described thus far, the first mode of the present invention provides a method for manufacturing a sintered rare-earth magnet having a magnetic anisotropy with a high density and a high degree of orientation, which is characterized in that it includes the steps of:

a) loading an alloy powder into a container (called "mold" hereinafter) having a cavity whose form corresponds to that of the product to be obtained;

b) applying a high magnetic field to the alloy powder to orient the alloy powder;

c) creating a sintered body by heating the alloy powder contained in the mold while allowing gas components released from the alloy powder to escape from the mold; and d) taking out the sintered body of the alloy powder from the mold.

Preferably, the cavity should be designed in consideration of the shape and size of the product to be obtained and the contraction that takes place during the sintering process. A sintered body having a high density and a high degree of orientation is defined as a body whose density is equal to or higher than 97% of the theoretical density, and whose degree of orientation, defined by the ratio of remnant magnetization ($J_r$) to saturation magnetization ($J_s$), is equal to or higher than 93% if the magnetization is measured by a pulsed magnetization measurement technique using the maximum field strength of 10 T.

The second mode of the method according to the present invention is characterized in that it includes:

a) loading an alloy powder into a mold with high density;

b) applying a high magnetic field to the alloy powder to orient the alloy powder;

c) creating a preliminary sintered body by heating the alloy powder contained in the mold while allowing gas components released from the alloy powder to escape from the mold;

d) taking out the preliminary sintered body from the mold or removing a portion of the mold, followed by a step of creating a sintered body by heating the preliminary sintered body at a temperature higher than the preliminary heating temperature; and e) taking out the sintered body from the remaining portion of the mold.

The third mode of the method according to the present invention depends on the first or second mode and is characterized in that the loading density of the alloy powder in the mold is within a range from 35 to 60% of the real density of the alloy.

If the alloy powder is simply permitted to freely fall into the cavity, the loading density of the powder is usually about 20% of the theoretical density. In the present invention, it is preferable to make the loading density equal to or higher than 35%. If the density is lower than 35%, the density of the sintered body after the sintering step will be too low, allowing large voids to be formed inside the sintered body. Such a sintered magnet is practically unusable. The loading density of 60% or higher is undesirable because it will impede the magnetic orientation of the alloy powder.

The fourth mode of the method according to the present invention depends on the third mode and is characterized in that the loading density of the alloy powder is within a range from 40 to 55% of the real density.

This range is more preferable than that specified in the third mode.

The fifth mode of the method according to the present invention depends on one of the first through fourth modes and is characterized in that the orienting magnetic field is 2 T or higher.

To obtain a sintered magnet having a degree of orientation ($J_r/J_s$) equal to or higher than 93%, the orienting magnetic field should be preferably 2 T or higher.

The sixth mode of the method according to the present invention depends on the fifth mode and is characterized in that the orienting magnetic field is 3 T or higher. This mode gives a more preferable range of the orienting magnetic field.

The seventh mode of the method according to the present invention depends on the sixth mode and is characterized in that the orienting magnetic field is 5 T or higher. This mode gives a still more preferable range of the orienting magnetic field.

The eighth mode of the method according to the present invention depends on one of the fifth through seventh modes and is characterized in that the orienting magnetic field is a pulsed magnetic field.

The ninth mode of the method according to the present invention depends on the eighth mode and is characterized in that the orienting magnetic field is an alternating magnetic field.

The tenth mode of the method according to the present invention depends on one of the fifth through ninth modes and is characterized in that the orienting magnetic field is applied multiple times.

The eleventh mode of the method according to the present invention depends on the tenth mode and is characterized in that the orienting magnetic field is a combination of an alternating magnetic field and a direct-current magnetic field.

The twelfth mode of the method according to the present invention depends on one of the first through eleventh modes and is characterized in that a lubricant is added to the alloy powder.

The thirteenth mode of the method according to the present invention depends on the twelfth mode and is characterized in that the lubricant consists of either a solid or liquid lubricant or both.

The fourteenth mode of the method according to the present invention depends on the thirteenth mode and is characterized in that the main component of the liquid lubricant is either fatty ester or depolymerized polymer.

Each of the sixth through fourteenth modes provides a means for enhancing the degree of orientation.

The fifteenth mode of the method according to the present invention depends on one of the first through fourteenth modes and is characterized in that the grain size of the alloy powder is 4 μm or smaller.

Powders having such a small grain size are too active to be used in the conventional magnet-manufacturing methods employing a die-pressing or RIP technique. The present invention allows use of such powders for the mass production of RFeB-based high-performance anisotropic sintered magnets.

The sixteenth mode of the method according to the present invention depends on the fifteenth mode and is characterized in that the grain size of the alloy powder is 3 μm or smaller. This condition makes the characteristics of the magnet higher than in the fifteenth mode.

The seventeenth mode of the method according to the present invention depends on the sixteenth mode and is characterized in that the grain size of the alloy powder is 2 μm or smaller. This condition makes the characteristics of the magnet higher than in the sixteenth mode.

The eighteenth mode of the method according to the present invention depends on the seventeenth mode and is characterized in that the grain size of the alloy powder is 1 μm or smaller. This condition makes the characteristics of the magnet higher than in the seventeenth mode.

The nineteenth mode of the method according to the present invention depends on one of the sixteenth through eighteenth modes and is characterized in that the grain size of the alloy powder is 3 μm or smaller and the sintering temperature is 1030 degrees Celsius or lower.

These conditions enhance the characteristics of the sintered RFeB magnet and make the life of the mold much longer.

The twentieth mode of the method according to the present invention depends on the nineteenth mode and is characterized in that the grain size of the alloy powder is 2 μm or smaller and the sintering temperature is 1010 degrees Celsius or lower. Compared to the nineteenth mode, the present mode further enhances the characteristics of the sintered RFeB magnet and makes the life of the mold still longer.

The twenty-first mode of the method according to the present invention depends on one of the first through twentieth modes and is characterized in that a portion or the entirety of the mold is used multiple times.

This is necessary to improve the productivity when the present invention is carried out on an industrial basis.

The twenty-second mode of the method according to the present invention depends on one of the first through twenty-first modes and is characterized in that the mold has multiple cavities.

The twenty-third mode of the method according to the present invention depends on one of the first through twenty-second modes and is characterized in that each cavity is pillar shaped.

This is a net-shape manufacturing method that can be used to produce a long product having a circular or irregular cross-section.

The twenty-fourth mode of the method according to the present invention depends on one of the first through twenty-third modes and is characterized in that a pillar-shaped core is provided at the center of a tubular cavity.

The twenty-fifth mode of the method according to the present invention depends on the twenty-fourth mode and is characterized in that, after the alloy powder is loaded into the cavity and the magnetic field is applied to orient the powder, the core is removed from the mold or replaced with a thinner one, after which the powder is sintered.

The twenty-fourth and twenty-fifth modes make it possible to produce a ring-shaped tubular magnet whose characteristics are comparable to those of the magnets created by a method that applies a pressure perpendicular the magnetic field. It was impossible to obtain such a magnet by conventional methods.

The twenty-sixth mode of the method according to the present invention depends on one of the twenty-third through twenty-fifth modes and is characterized in that the magnetic field is applied along the axial direction of the cavity to orient the alloy powder.

The twenty-seventh mode of the method according to the present invention depends on the twenty-sixth mode and is characterized in that the portions corresponding to the cover and the bottom of the cavity at both ends in the axial direction are made of a ferromagnetic material.

The twenty-sixth and twenty-seventh modes provide means for minimizing the distortion of the pillar-shaped or cylindrical sintered body.

The twenty-eighth mode of the method according to the present invention depends on the twenty-second mode and is characterized in that the cavity is plate shaped. This mode provides a highly productive means for producing plate magnets.

The twenty-ninth mode of the method according to the present invention depends on the twenty-second mode and is characterized in that the cavity is shaped like an arched plate. This mode provides a highly productive means for producing arched plate magnets.

The thirtieth mode of the method according to the present invention depends on the twenty-eighth or twenty-ninth mode and is characterized in that the magnetic field is applied along the direction perpendicular to the flat or arched surface of the cavity to orient the alloy powder.

The thirty-first mode of the method according to the present invention depends on the thirtieth mode and is characterized in that the flat or arched surface of the cavity is made of either a nonmagnetic material or a material whose saturation magnetization is 1.5 T or lower.

The thirty-second mode of the method according to the present invention depends on the twenty-first mode and is characterized in that the saturation magnetization is 1.3 T or lower.

The thirtieth through thirty-second modes provide means for obtaining a high density, void-free sintered body when a plate magnet or an arched plate magnet is manufactured.

The thirty-third mode of the method according to the present invention depends on one of the twenty-second through thirty-second modes and is characterized in that two or more rows of cavities are arranged in the mold.

The thirty-fourth mode of the method according to the present invention depends on one of the first through thirty-third modes and is characterized in that the portion of the mold that forms a wall parallel to the direction of orienting the alloy powder by the magnetic field is partially or entirely made of a ferromagnetic material.

The thirty-fifth mode of the method according to the present invention depends on one of the first through thirty-fourth modes and is characterized in that the inner wall of the cavity is covered with an anti-burning coating.

The thirty-sixth mode of the method according to the present invention depends on one of the first through thirty-fifth modes and is characterized in that the alloy powder is forcefully loaded into the mold by one or a combination of two or more of the following methods: a mechanical tapping method that employs mechanical vibration, a pressure method that uses a push rod, and an air-tapping method that uses a strong flow of air.

The thirty-seventh mode of the method according to the present invention depends on one of the first through thirty-sixth modes and is characterized in that the alloy powder is a fine powder obtained by pulverizing an alloy created by quenching a molten metal.

The first mode of the system for manufacturing a sintered rare-earth magnet having a magnetic anisotropy is characterized in that it includes:

a) an alloy powder loading means for loading an alloy powder, created by pulverizing an alloy, into a mold with high density;

b) an orienting means for orienting the alloy powder in a magnetic field, c) a sintering means for sintering the alloy powder while it is held in the mold;

d) a transferring means for transferring the mold from the alloy powder loading means through the orienting means to the sintering means;

e) a container enclosing the alloy powder loading means, the orienting means, the sintering means and the transferring means; and f) an atmosphere regulating means for filling the inner space of the container with an inert gas atmosphere or evacuating the inner space.

The second mode of the system for manufacturing a sintered rare-earth magnet having a magnetic anisotropy is characterized in that it includes:

a) an alloy powder loading means for loading an alloy powder, created by pulverizing an alloy, into a mold with high density;

b) an orienting means for orienting the alloy powder in a magnetic field, c) a preliminary sintering means for preliminarily sintering the alloy powder held in the mold until the powder can retain its shape;

d) a main sintering means for fully sintering the preliminarily sintered alloy powder;

e) a transferring means for transferring the mold from the alloy powder loading means through the orienting means and the preliminary sintering means to the main sintering means;

f) a container enclosing the alloy powder loading means, the orienting means, the preliminary sintering means, the main sintering means and the transferring means; and g) an atmosphere regulating means for filling the inner space of the container with an inert gas atmosphere or evacuating the inner space.

These modes provide means for improving the safety level of the system for carrying out the present invention.

The third mode of the manufacturing system according to the present invention is characterized in that it includes an outer container that encloses the aforementioned container. This mode provides a means for further improving the safety level of the system for carrying out the present invention.

Modes for Carrying out the Invention and Their Effects

According to the present invention, the method for manufacturing a sintered rare-earth magnet having a magnetic anisotropy includes a step of loading a fine powder into a mold having a cavity, followed by the steps of orienting the powder by an external magnetic field and sintering the powder intact. The shape and size of the cavity are designed according to the shape and size of the product to be obtained. Preferably, the design should take into account the contraction that will occur in the sintering process.

The method according to the present invention is applicable to the production of RCo (rare-earth cobalt) magnets or RFeB (rare-earth/iron/boron) magnets.

According to the present invention, after the fine powder is loaded into the mold, a magnetic field is applied and then the sintering step is immediately performed. This process never allows the fine particles to fly around, so that even a fine powder of a rare-earth magnet can be handled safely.

According to the present invention, the steps of loading the fine powder, applying the magnetic field and transferring it to the sintering furnace are all performed under an atmosphere of argon, nitrogen or other inert gases or under vacuum. Rare-earth magnets are influenced by impurities, such as oxygen. Irrespective of whether the magnet is an RFeB or SmCo type, it is necessary to determine its composition so that it will contain a larger amount of the rare earth than its stoichiometric composition, taking into account the amount of the rare earth that will be oxidized. However, in this case, the nonmagnetic phase also increases, which deteriorates the characteristics. If the process according the present invention is used to manufacture an RFeB, SmCo or other type of rare-earth magnet, the fine powder will never come in contact with air, so that the resultant sintered body will contain less oxygen. Since there is no need to estimate the amount by which the rare earth will be oxidized, the total amount of the rare earth (Nd, Sm) can be reduced to the minimum level, which in turn improves the magnetic characteristics. Due to the absence of the compression process, the degree of orientation remains at a high level, so that $B_r$ and the energy product will be high.

According to the present invention, the sintering step (in the first mode) or the preliminary sintering step (in the second mode) is performed under the condition that gas components released from the alloy powder can escape to the outside of the mold. Therefore, the mold must have an opening, small hole, narrow gap, groove or similar structure through which the gas can escape during the sintering or preliminary sintering process. Such a structure may be present from the start. Alternatively, it may be formed after the alloy powder is loaded and the orienting magnetic field is applied.

The powder sometimes contains a large amount of hydrogen absorbed in the alloy during the hydrogen pulverization and always contains nitrogen, moisture and other adsorbed gas components. Moreover, a portion or the entirety of the lubricant or binder mixed with the fine powder vaporizes at high temperatures. These gas components need to be discharged from the mold to the outside during the sintering or preliminary sintering process. If these gas components remain inside the mold, the density of the sintered body does not increase during the sintering process. Furthermore, the remnant components may react with the sintered body and contaminate it, causing an unfavorable effect on its magnetic characteristics. To discharge such gas components, the mold may be provided with a narrow gap or small hole beforehand. It is also possible to create an opening by removing a portion of the outer wall or the core (in the twenty-fourth or twenty-fifth mode) of the mold after the alloy powder is loaded into the mold, the cover is closed and the orienting magnetic field is applied. The narrow gap or small hole may be a naturally formed one, e.g. a gap at the interface between the cavity and the cover.

According to the present invention, it is possible to load a fine powder into a mold having a cavity designed according to the desired shape and size, to orient the powder by externally applying a magnetic field, and to immediately bring it to the (preliminary) sintering process.

The fine powder of the magnetic alloy is loaded into the mold with high density. The loading density is higher than in the case of the conventional die-pressing method but lower than the relative density of the powder compact obtained by the conventional die-pressing, CIP or RIP method. The conventional methods required the compact to be durable so that it endured the handling process. In contrast, the present invention does not include such a handling process. Therefore, it is unnecessary to compress the powder.

The alloy powder must be uniformly loaded into the mold with adequately high density. Otherwise, the density of the sintered body will be too low. Furthermore, the pulsed magnetic field applied for orientation will cause an uneven distribution of the powder, which leads to the creation of voids inside the sintered body.

In the present invention, the rare-earth magnet is preferably an RFeB magnet.

An RFeB magnet contains, in atomic percentage, 12 to 20% of R (which is at least one kind of rare-earth elements including Y) and 4 to 20% of B, with the remaining percentage essentially consisting of Fe.

Less than 50% of Fe may be replaced with Co in order to improve the temperature characteristic and the corrosion resistance of the magnet or enhance the stability of the fine powder.

It is possible to add Ti, Ni, V, Nb, Ta, Cr, Mo, W, Mn, Al, Sn, Zr, Hf, Ga or other elements in order to enhance the coercive force or improve the sinterability and other productivity factors. Multiple addition of the above-listed elements is allowable, although the total amount does not preferably exceed 6 atomic percent. Particularly preferable elements are Cu, Al, V and Mo.

For RFeB magnets, the sintering is performed at temperatures of 900 to 1200 degrees Celsius.

The method for manufacturing a rare-earth magnet according to the present invention can also be used to produce rare-earth cobalt magnets (i.e. RCo magnets).

The composition of a 1-5 type RCo magnet can be expressed as RTx (where R is either Sm or a combination of Sm and one or more of La, Ce, Pr, Nd, Y and Gd; T is either Co or a combination of Co and one or more of Mn, Fe, Cu and Ni; $3.6<x<7.5$). Its sintering temperature is 1050 to 1250 degrees Celsius.

A 2-17 type RCo magnet is composed, by weight, of 20 to 30% of R (which is either Sm or two or more of rare-earth elements containing more than 50% of Sm), 10 to 45% of Fe, 1 to 10% of Cu, 0.5 to 5% of one or more of Zr, Nb, Hf and V, with the remaining percentage consisting of Co and unavoidable impurities. The sintering temperature is 1050 to 1200 degrees Celsius.

Irrespective of whether the magnet is a 1-5 or 2-17 type, it is possible to increase its coercive force by performing a heat treatment at 900 degrees Celsius or lower during the sintering process.

To produce a magnet having high characteristics, it is desirable to improve the coercive force by increasing the sintered density and performing the sintering process without causing the grain growth. The optimal sintering temperature can be defined as the temperature at which the sintered density is adequately increased without causing the grain growth. The optimal sintering temperature depends on the composition and the grain size of the magnet, the sintering period of time and other factors.

In the present invention, the preliminary sintering process is continued until a portion of the fine particles combine with each other and retain its shape. For this purpose, the preliminary sintering temperature should be preferably 500 degrees Celsius or higher. If the life of the mold is regarded as important, the sintering temperature can be lower than the optimal sintering temperature by 30 degrees Celsius or more so that the sintered product will not burn dry on the mold. At the optimal sintering temperature, the loaded powder is so reactive that it tends to burn dry on the mold.

RFeB magnets and RCo magnets contain a larger percentage of rare-earth elements than the stoichiometric composition ($R_2Fe_{14}B$ or $RCo_5$) of the intermetallic compounds. The rare-earth elements form a low-melting alloy with other elements, causing the liquid phase sintering. Through the liquid phase sintering process, the alloy powder loaded in the mold contracts from the loaded state to a sintered body having a high density. If the powder is sintered in a ring-shaped tubular mold having a cylindrical cavity with a pillar-shaped core located at its center, the core impedes the contraction of the powder, causing cracks in the inner circumference of the sintered body. To create a sintered body free from the cracks, there are several measures: to remove the core or transfer the preliminary sintered body to another container designed for the main sintering process after the preliminary sintering; or to remove the core or replace it with a thinner one after the powder loaded in the mold is oriented with the magnetic field and before the heating process for the preliminary or main sintering is started.

Another feature of the present invention is that the mold has a cavity designed so that the sintered magnet obtained after the sintering process has a desired shape and size, and that the mold is repeatedly used. This is an essential condition for the present invention to be industrially usable because sintered rare-earth magnets are often produced in units of one million pieces for each product. The present inventors have demonstrated that the mold can be repeatedly used on an industrial basis if the techniques proposed in this patent application satisfy certain conditions.

To further improve the productivity, the present invention proposes use of a mold having multiple cavities. Compared to the die-pressing method and the RIP method as the conventional techniques, the present method is overwhelmingly advantageous in that the number of plate magnets or arched plate magnets that can be created with a single mold is several times as large as that in the conventional cases, and that the magnetic characteristics of the magnets thereby created are uniform and vary nominally from piece to piece. This is because the present invention allows a very long air-core coil to be used to orient the alloy powder. For example, use of a Bitter type coil whose coil is 20 cm long enables a single mold to create as many as 30 pieces of sintered rare-earth magnets having a typical shape of a flat or arched plate. Since the magnetic field within the coil is uniform, the magnetic characteristics of the plate magnets or arched plate magnets thereby-created will be uniform, with little variation from piece to piece. The reason for the use of the Bitter coil is that, as a coil for repeatedly generating a high magnetic field, the life of the Bitter type coil is longer than that of normal wound coils.

Selection of the mold material is important for industrial applications of the present invention. For example, suppose that an iron mold is used to create a plate magnet. In this case, when the pulsed magnetic field is applied, the alloy powder in the mold will be pressed onto the circumferential portion of the plate. If the powder is sintered in this state, the resultant sintered body will have a large void at the center of the plate, while the other portion of the plate will be sintered with a high degree of orientation and high density. Naturally, such a magnet is disqualified for industrial applications. This problem can be solved by correctly selecting the material of the mold, that is, by using either a nonmagnetic material or a material whose saturation magnetization is as low as 1.5 T or even lower, more preferably 1.3 T or lower, as a material of the flat or arched surface of the cavity.

If the portion of the mold that forms a wall parallel to the direction of orienting the alloy powder by the magnetic field may be partially or entirely made of a ferromagnetic material, the orientation of the magnetically aligned alloy powder will be fixed and stabilized as a magnetic circuit. In this case, since the misorientation will not occur even if the mold receives some impacted force while it is being handled after the magnetic orientation process, it will be possible to make the manufacturing system operate more quickly and stabilize the production. Similarly, if the cavity is either a pillar-shaped type or a ring-shaped tubular type, it is preferable to use a ferromagnetic material as a material of the portions corresponding to the cover and the bottom of the cavity at both ends in the axial direction (or depth direction). This construction will stabilize the orientation of the magnetically oriented alloy powder.

To repeatedly use the mold, it is possible to coat the mold with a substance that prevents the alloy powder from burning dry on the mold. An effective coating technique for preventing this burning is BN (boron nitride) coating. As a method of BN coating, a mechanical application of a BN powder is effective in preventing this burning to some extent. To thoroughly prevent this burning, it is desirable to fix the BN powder onto the mold more firmly. If a resin is used as the binder for fixing the BN powder, the coating should be done for every sintering process. Burning the BN powder onto the inner surface of the mold with the binder consisting of a metal or glass will create a coating that can be used multiple times. A thin film coating consisting of various kinds of nitrides, carbides or borides, such as TiN, TiC, and $TiB_2$, or oxides such as alumina, created by sputtering, ion plating, CVD or other techniques, will effectively work as a durable, smooth-surfaced anti-burning coating that can be used multiple times.

The crystal grain size of sintered neodymium magnets produced by world-class makers is within the range from 5 to 15 μm; the grain size of the fine powder before the sintering process is 4.5 to 6 μm in $D_{50}$, i.e. the median of the grain size measured with a laser-type grain-size distribution measurement apparatus (produced by Sympatec GmbH, HORIBA, Ltd., etc.). Previously, the grain size of fine powders was measured with an air permeability type grain-size distribution measurement apparatus (Fisher Sub-Sieve Sizer: F.S.S.S); a measurement value of 3 μm by F.S.S.S corresponds to about 4.5 to 5 μm in $D_{50}$. In the production of a rare-earth magnet made of an alloy containing 30% in weigh or more of rare-earth elements, it was difficult to handle a fine powder of 4.5

μm or smaller in $D_{50}$ (3 μm by F.S.S.S) by the conventional die-pressing method. In the present invention, the process in which the fine powder is loaded into a mold, oriented by a magnetic field and transferred to the sintering furnace is performed under an atmosphere of nitrogen or other inert gases. Since the powder does not come in contact with air, even a fine powder can be handled safely.

Conventional manufacturing processes employing the die-pressing, CIP or RIP methods are unsuitable for handling a fine powder of an RFeB magnet alloy abundant in chemically active rare-earth elements. Exposing a fine powder of RFeB alloy having a grain size of 4 μm or smaller to air is liable to cause ignition or explosion if the powder is not oxidized, so that stable production is impossible. Even if the ignition does not occur, the large surface area of the fine powder leads to an increase in the oxygen amount, which deteriorates the magnetic characteristics. None of the conventional methods could avoid these problems. Therefore, it was impossible to industrially handle a large amount of fine powder having a grain size of 4.5 μm or smaller.

If the present invention is used to create a sintered magnet from an RFeB alloy powder having a $D_{50}$ value of 4 μm or smaller, the resultant neodymium magnet will have a high degree of orientation, a high energy product and a high coercive force.

The present invention makes it possible to mass-produce RFeB magnets having high coercive forces on a stable basis, without using the rare and expensive elements of Dy and Tb, or using only a small amount of such elements. The magnets thereby obtained can be used in hybrid cars or industrial motors.

One feature of the present invention is that it does not perform a pressing process after orienting the powder, as opposed to the die-pressing, CIP or RIP method. After being oriented in the mold, the powder maintains its orientation undisturbed by an application of a pressure as in the case of the conventional methods. Thus, the powder is sintered while maintaining a high degree of orientation. The high degree of orientation realizes a high residual magnetic flux density ($B_r$) and a high maximum energy product ($(BH)_{max}$).

The conventional methods do not provide any means for handling a magnet powder containing rare-earth elements whose $D_{50}$ value is 3 μm, 2 μm, 1 μm or even smaller to further enhance the coercive force. In contrast, the method according to the present invention can handle a magnet powder containing rare-earth elements whose $D_{50}$ value is 0.5 μm or smaller because the process after the preparation of the fine powder until the sintering is entirely performed under inert atmosphere.

The magnet alloy powder can be produced by pulverizing either a cast ingot created by melting a mixture of components with a smelting furnace or a cast piece created by quenching a molten metal (i.e. strip-casting method). Normally, if a fine powder of several μm in grain size is to be obtained, the pulverization process takes two steps: coarse pulverization and fine pulverization. Examples of the coarse pulverization methods are the mechanical pulverization and the hydrogen pulverization. In the latter method, the object is set in a hydrogen gas to make it occlude hydrogen until it is broken. The hydrogen pulverization is more productive and therefore widely used. Typical methods for fine pulverization are a method that uses a ball mill or an attriter, and a jet mill pulverization method, which uses a flow of nitrogen gas or other gas to pulverize the object. The present invention, which is characterized by the use of a fine powder having a grain size of a few μm, puts no restriction on the method for producing the fine powder; any method is acceptable in addition to the aforementioned ones.

In the present invention, the loading density of the powder in the mold should be preferably from 35 to 60% of the real density, more preferably from 40 to 55%.

The conventional methods (die-pressing, CIP and RIP) required the powder compact to be strong enough to undergo a handling step that leads to subsequent steps. Therefore, the pressure needed to exceed the level necessary for obtaining adequate magnetic characteristics. In contrast, the present invention does not include the step of handling the powder compact, so that there is no need to consider the strength of the powder compact, as in the conventional methods.

Preferable methods for loading the powder are a mechanical tapping method that employs mechanical vibration, a pressure method that uses a push rod to be pressed into the mold, and an air-tapping method disclosed in Unexamined Japanese Patent Publication No. 2000-96104. A magnet powder measuring in units of micrometers, which is easy to cohere and liable to form a bridge, is difficult to uniformly load into the mold. The mechanical tapping method or the pressure method mechanically destroys the bridge to load the powder with high density. Alternatively, the air-tapping method can be used to periodically impact the powder in the powder feeder with a flow of air in order to constantly and uniformly load the powder into the mold with high density.

Unexamined Japanese Patent Publication No. 2000-96104 discloses a method including the following steps: a powder containing a binder and other additives beforehand is loaded into the mold by the air-tapping method; the binder is hardened by heating or other processes to combine the powder to obtain a shaped body; and the shaped body is sintered. However, this invention does not relate to a method for manufacturing a magnet; it lacks the step of orientation by a magnetic field and does not present the idea of (preliminarily) sintering the powder in the state of being held in a mold. In contrast, in the present invention, no binder is used to create a shaped body of a powder, and there is no need to handle a shaped body of a powder solidified with a binder.

The source of the external magnetic field for orienting the powder should be preferably a pulsed magnetic field. The mold filled with the powder is set within the air-core coil, and the pulsed magnetic field is applied to it. The strength of a static magnetic field generated with an electromagnet used in the die-pressing method is 1.5 T at most. In contrast, the pulsed magnetic field can reach much higher strength levels. In the present invention, the strength of the pulsed magnetic field needs to be 2 T or higher, preferably 3 T or higher, and more preferably 5 T or higher. The method of applying the pulsed magnetic field for orienting the powder should preferably include a step of applying a damped alternating magnetic field followed by a step of applying a direct-current pulsed magnetic field, rather than applying a one-time direct-current pulse.

In Japanese Patent No. 3307418, it is confirmed that the magnetic characteristics of an RFeB magnet improves if a magnetic field of 1.5 to 5 T is applied to it. However, if a pulsed magnetic field is applied to a conventional die-pressing machine, an eddy-current loss or a hysteresis loss occurs in the die, so that it cannot be continuously used. Furthermore, the impact force caused by the pulsed magnetic field may break the die.

The powder-orienting magnetic field in the present invention may be generated using a superconductivity coil or other devices, if the device can create an adequately strong magnetic field.

A sintered rare-earth magnet having good magnetic characteristics needs to have a dense and uniform microstructure. To obtain such a sintered body, a strip-casting method was proposed as a method for obtaining a fine and dense alloy ingot (Japanese Patent No. 2665590 etc.). The conventional method for manufacturing an RFeB magnet uses a thin strip of strip-cast alloy of about 300 μm in thickness. In the present invention, the thickness of the thin-strip alloy should be preferably 250 μm or smaller. If a fine powder having a grain size of 3 μm or smaller in $D_{50}$ is to be obtained, the thickness of the thin strip should be preferably 200 μm or smaller. If a fine powder having a grain size of 2 μm or smaller in $D_{50}$ is to be obtained, the thickness of the thin strip should be preferably 150 μm or smaller. Use of a fine powder produced from a thin-strip alloy having an appropriate thickness will maximize the coercive force of the sintered neodymium magnet that will be finally obtained.

In the present invention, the process from the step of taking out a fine powder from the pulverizer to the step of transferring it to the sintering furnace is entirely performed under inert atmosphere. The fine powder put on the hopper is loaded into the mold set in the inert gas atmosphere through the high-density filling means, such as a mechanical tapping or air-tapping unit. Then, a cover is put on the mold, which is moved to the point where the orienting means is located. The powder in the mold is oriented by the orienting means, such as a pulsed magnetic field. Then, it is directly conveyed to the entrance of the sintering furnace.

Adding a liquid lubricant to the fine powder before loading the powder into the mold is preferable because it facilitates the orientation in the magnetic field and thereby helps the degree of orientation to increase.

In general, solid lubricants have low vapor pressures and high boiling points, whereas liquid lubricants have high vapor pressures and low boiling points. In the present case, liquid lubricants are more preferable because it is faster to spread into the entire fine powder and easier to degrease.

It is known that methyl caproate or methyl caprylate can be used as a liquid lubricant with saturated fatty acid (Unexamined Japanese Patent Publication No. 2000-109903). However, in the case of the die-pressing method, these liquid lubricants can be used by only a small amount of 0.05 to 0.5 weight percent of the magnet powder. Although these lubricants are highly volatile and do not remain in the sintered body, it is difficult to remove the lubricant components through the sintering process if they are confined within the powder compact that has been firmly compressed by die-pressing. At high temperatures, these lubricant components may react with the magnet component and thereby deteriorate the magnetic characteristics.

In the present invention, the powder in the mold is not compressed, so that the lubricant components can easily vaporize and escape. Therefore, it is recommendable to add the largest possible amount of the liquid lubricant. However, adding too much lubricant would prevent the high-density loading of the powder. A preferable range of the content of the liquid lubricant is from 0.1 to 1%.

In the present invention, any liquid lubricant can be used as long as it has lubricity and easily vaporizes. Examples include methyl octylate, methyl decanoate, methyl caprylate, methyl laurate, methyl myristate, methyl palmitylate and methyl stearate. Compared to these liquid lubricants, zinc stearate and other lubricants that are solid at room temperature have the shortcoming that they are difficult to evenly apply on the surface of the powder particles. However, it is possible to make full use of the lubricating effect of solid lubricants by using a specific type of mixer (e.g. Super Mixer, manufactured by KAWATA MFG Co., Ltd.) or a similar machine that can thoroughly apply a solid lubricant on the surface of powder particles. Compared to a powder to which a liquid lubricant is added, a powder with a solid lubricant added to it by the aforementioned method is harder to turn into a solid when it is compressed. Use of such a powder in the method for manufacturing a rare-earth magnet according to the present invention prevents the phenomenon that the powder is pressed toward the circumferential portion and turns into a solid during the pulse orientation process, and that a void is formed at the center of the sintered body during the sintering process.

Effect of the Present Invention

The present invention has been discovered as a technique for solving various problems and contradictions found in the conventional methods for manufacturing a sintered magnet having a magnetic anisotropy, such as RFeB, RCo and other rare-earth magnets. According to the present invention, it is unnecessary to use large-scale molding equipment, such as a die-pressing machine. Since there is no need to create a durable powder compact for handling, the misorientation never occurs and the resultant sintered magnet having a magnetic anisotropy has a net shape. Even if neither Tb nor Dy is used, it is possible to create a rare-earth magnet having a high coercive force by applying a strong, pulsed magnetic field through the air-core coil and by using a fine powder having a small grain size with low oxygen content, which can be produced by treating a chemically active fine powder containing a rare-earth element while preventing the powder from being in contact with air. It is also possible to efficiently produce high-performance magnets having the most widely produced shapes for commercial rare-earth magnets, such as the thin plate and arched plate types.

Figure 1:
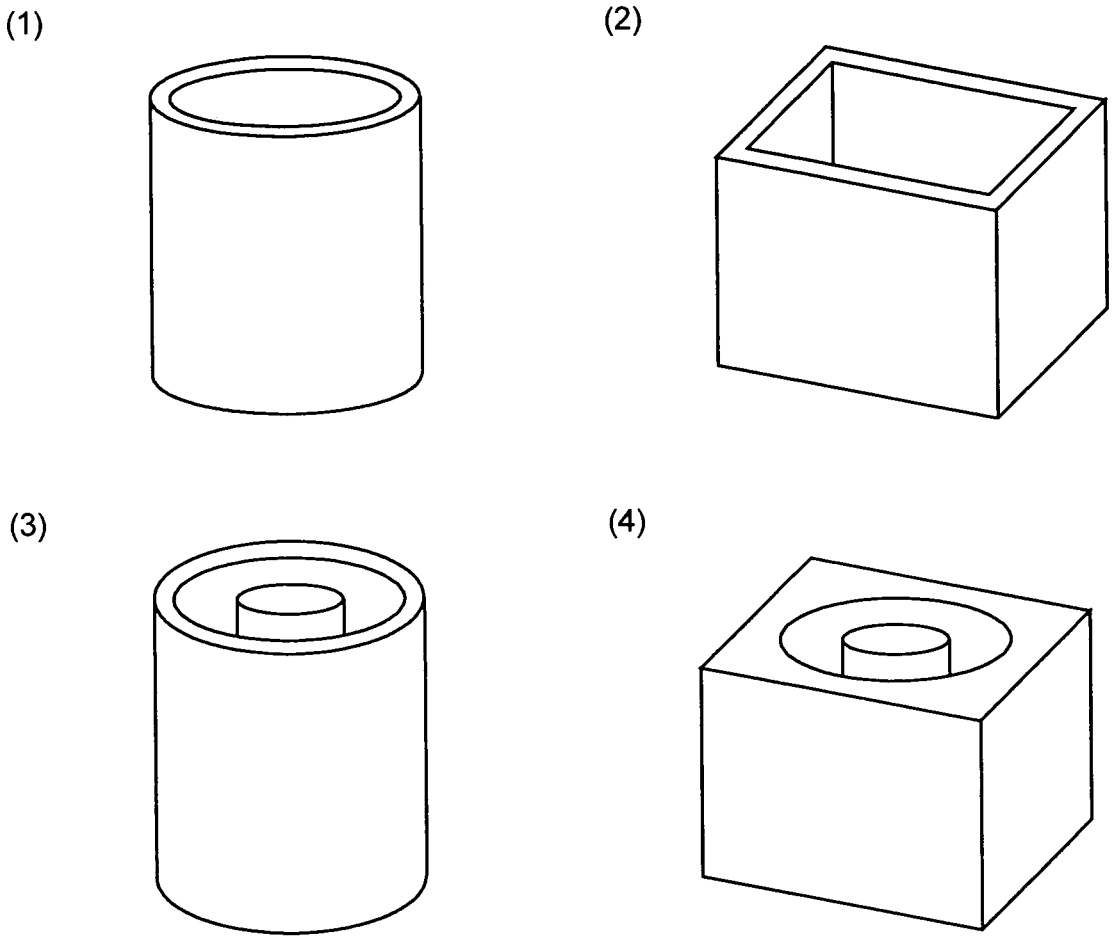
FIG. 1 is a perspective view of examples of the single-cavity mold used for carrying out a method for manufacturing a sintered rare-earth magnet having a magnetic anisotropy according to the present invention.

| EXPLANATION OF NUMERALS | |
|---|---|
| 40 | Partition |
| 41 | Weighing and Loading Section |
| 42 | High-Density Loading Section |
| 43 | Magnetic Orientation Section |
| 44 | Sintering Furnace |
| 45 | Conveyer |
| 46 | Mold |
| 47 | Hopper |
| 48 | Guide |
| 49 | Cover |
| 50 | Pressure Cylinder |
| 51 | Push Rod |
| 52 | Tapping Machine |
| 53 | Holder |
| 54 | Coil |
| 55 | Outer Wall |

EMBODIMENTS

[Mold]

Preferably, the mold should be made of a material that can withstand the high sintering temperature (up to 1100 degrees Celsius). In the course of pre-heating the mold, the particles loosely combine with each other, whereby the object to be sintered becomes able to sustain its shape. In this preliminary sintered state, a portion or the entirety of the mold can be removed so that the preliminary sintered body can be set into another mold or onto a bedplate. The preliminary sintering temperature is preferably from 500 degrees Celsius to a level that is 30 degrees Celsius lower than the sintering temperature. The mold used in the preliminary sintering process can be made of any material that withstands the above temperature range.

Examples of the mold material include iron, iron alloy, stainless steel, permalloy, heat resisting steel, heat resisting alloy and superalloy; molybdenum, tungsten and their alloy; and ferrite, alumina and other ceramics.

[Coating on the Inner Wall of the Mold]

To prevent the sintered body from adhering to the inner wall of the mold during the sintering process, it is effective to apply a mold release agent, such as BN, on the inner wall of the mold beforehand. For the production of high-quality sintered magnets, it is effective to apply BN on the inner wall of the mold or form a thin film of Mo, W or other high-melting metals on the inner wall by a thermal spraying technique in order to prevent the phenomenon that the sintered body sticks to the inner wall of the mold during the sintering process and that the sintered body is deformed or broken due to the sticking. A thin film of TiN, TiC, TiB, $Al_2O_3$, $ZrO_2$ or other materials can be formed on the surface of a mold made of a stainless steel or other materials by sputtering, CVD or ion plating. The resultant film functions as a durable anti-adhesion coating.

[Loading Method]

The loading is an important process in the present invention. A fine powder of permanent magnet alloy, which cannot be granulated, is difficult to be constantly loaded into the mold because its particles each behave as a magnet and easily cohere and form a bridge. The forceful loading methods available in the present invention are a mechanical tapping method, a pressure method and an air-tapping method; the last one is an invention of the present inventors (Unexamined Japanese Patent Publication No. 2000-96104).

[Loading Density]

The loading density should be preferably from 35 to 65% of the real density of the alloy. If the density is lower than 35%, the sintered body will have a large void, or the entire sintered body will be porous and low density, so that the resultant product will be impractical. To obtain a practically usable, high-quality permanent magnet, the loading density needs to be 35% or higher. However, a loading density higher than 60% will prevent the powder from being adequately oriented by the magnetic field. More preferably, the loading density should be within a range of 40 to 55% in order to obtain a high-density sintered body that is adequately oriented and free from voids or cracks.

Figure 2:
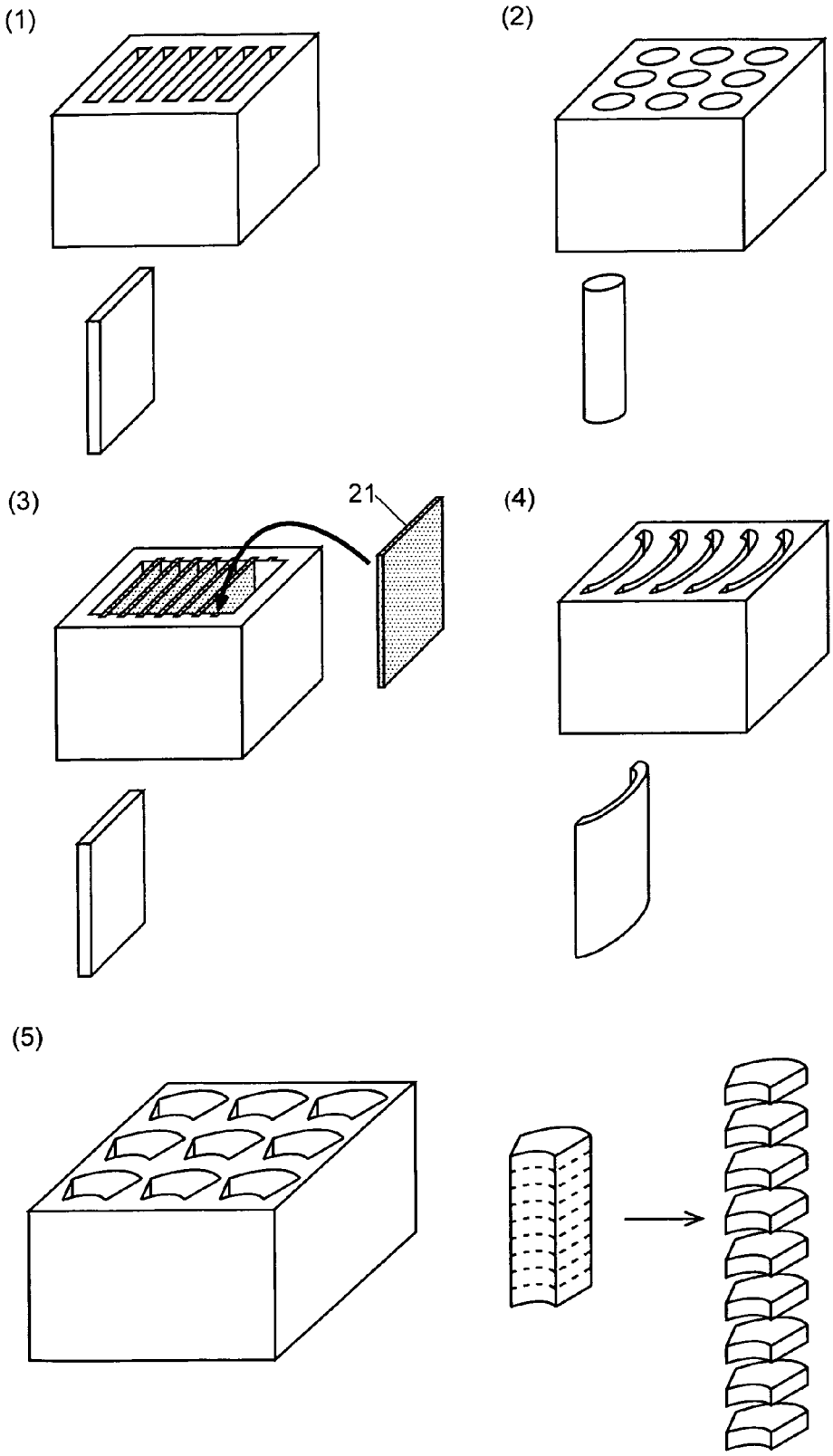
FIG. 2 is a perspective view of examples of the multi-cavity mold used for carrying out a method for manufacturing a sintered rare-earth magnet having a magnetic anisotropy according to the present invention.
Figure 3:
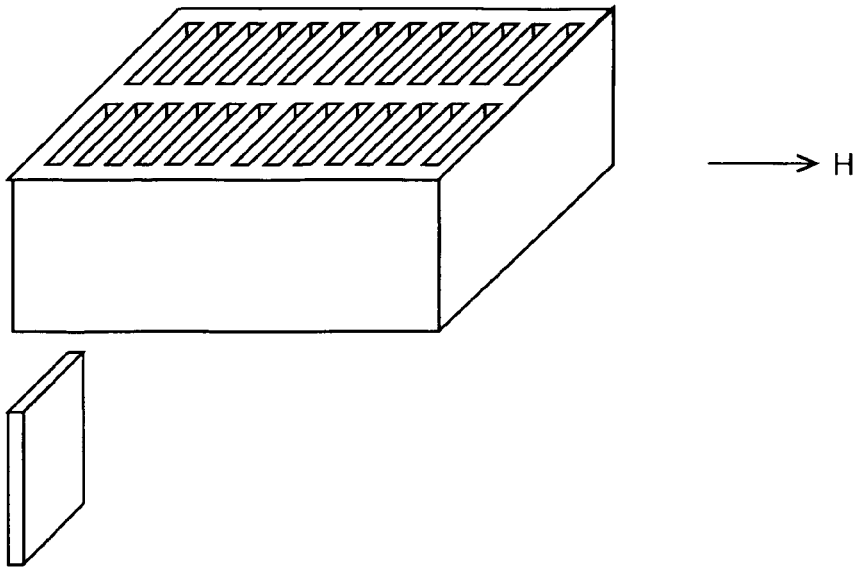
FIG. 3 is a perspective view of another example of the multi-cavity mold used for carrying out a method for manufacturing a sintered rare-earth magnet having a magnetic anisotropy according to the present invention.

The mold may be a single-cavity type corresponding to the shape to be created, as shown in FIG. 1. To improve the manufacturing efficiency, it is possible to use a multi-cavity mold, as shown in FIG. 2 or 3. The partition between the neighboring cavities may be a removable thin plate (e.g. partition 21 in FIG. 2 (3)). The molds shown in FIGS. 2 (1), (2), (4) and (5) can be created by directly boring cavities having a desired shape in a solid material by machining with a drill or an end mill or by electric discharge machining. By preparing a mold having a cavity in a predetermined shape calculated back from the contraction coefficient beforehand and then forcefully filling the mold with the powder, it is possible to obtain a homogeneous sintered body having a desired shape.

If a conventional die-pressing method is used, the perforated, ring-shaped tubular magnet created by the mold shown in FIG. 1 (3) or (4) could be manufactured only by applying a pressure parallel to the magnetic field. However, the magnetic characteristics of sintered magnets manufactured by applying a pressure parallel to the magnetic field are low. Therefore, development of a method for a ring-shaped tubular magnet whose magnetic characteristics is as high as those obtained by applying a pressure perpendicular to the magnetic field, or even higher, has been desired. In an attempt, a metallic rod (or core) was set at the center of a rubber mold, which was compressed by a CIP or RIP method after a pulsed magnetic field was applied. However, the product did not have a good net shape and the productivity was low. In the manufacturing method according to the present invention, it is possible to start the sintering process immediately after loading the powder into the mold and orienting it by a pulsed magnetic field. In view of the contraction that will take place in the inner circumference, when the shape has been retained by the preliminary sintering, the preliminary sintered body is taken out from the mold shown in FIG. 1 (3) or (4) and put into another mold for the main sintering, or the core is removed, before the main sintering process is performed. Alternatively, the main sintering process may be performed after removing the core or replacing it with a thinner one after the magnetic orientation of the powder and before the heating. Thus, it is possible to manufacture a sintered, ring-shaped tubular RFeB magnet whose magnetic characteristics are as high as those obtained by applying a pressure perpendicular to the magnetic field. The mold cavity, which is shaped cylindrical in the examples shown in FIGS. 1 (3) and (4), may have a different shape, such as a hexagon. Similarly, the core may not be shaped cylindrical but hexagonal or in other forms.

FIG. 1 (2) shows an example of a mold for a large-size block. According to the present invention, it is easy to manufacture a large-size product that was difficult to create by the conventional die-pressing method due to the limitations of the pressure level and the area of the uniform magnetic field.

FIG. 2 (3) shows a mold for creating plate magnets, in which the cavity is separated by thin partitions. Use of this mold enables multiple pieces to be simultaneously created.

FIG. 2 (4) shows a mold for creating arched plate magnets used in motors and other devices. According to the present invention, it is easy to manufacture a product having a shape that was difficult to create by the conventional die-pressing method. The partitions may be also removable, as in FIG. 2 (3).

FIG. 2 (5) shows a mold for creating pillar-shaped magnets having a sector-shaped cross section. The resultant pillar-shaped magnet can be cut into pieces having a specific thickness. These magnet pieces can be used in voice coil motors and other devices.

FIG. 3 shows an example of a mold that can simultaneously create a larger number of plate magnets than those shown in FIGS. 2 (1) and (3). Since the method according to the present invention does not need to use a die-pressing machine, it is possible to arrange the plate-shaped cavities in two rows. Although not shown in the drawing, it is possible to arrange the cavities in three or more rows. Of course, arched plate type or other types of cavities can be arranged in two or more rows instead of the plate-shaped cavities. In the present invention, the process of orienting the fine powder can use a coil having an air-core that is larger than that used in the conventional methods. Therefore, even if the cavities are arranged in two or more rows, the piece-to-piece variation in the magnetic characteristics of the plate magnets is adequately reduced.

[Cover]

After the fine powder is loaded into a mold shown in one of FIGS. 1-3, a cover is put on the mold, and a pulsed magnetic field is applied to orient the powder. The application of the pulsed magnetic field to the powder makes each particle of the powder behave as a magnet. The north poles of the magnets repel each other, and so do their south poles. As a result, the volume of the powder significantly increases. Without the cover, or if the cover is not correctly set, the powder will be scattered during the orienting process by the pulsed magnetic field.

Figure 4:
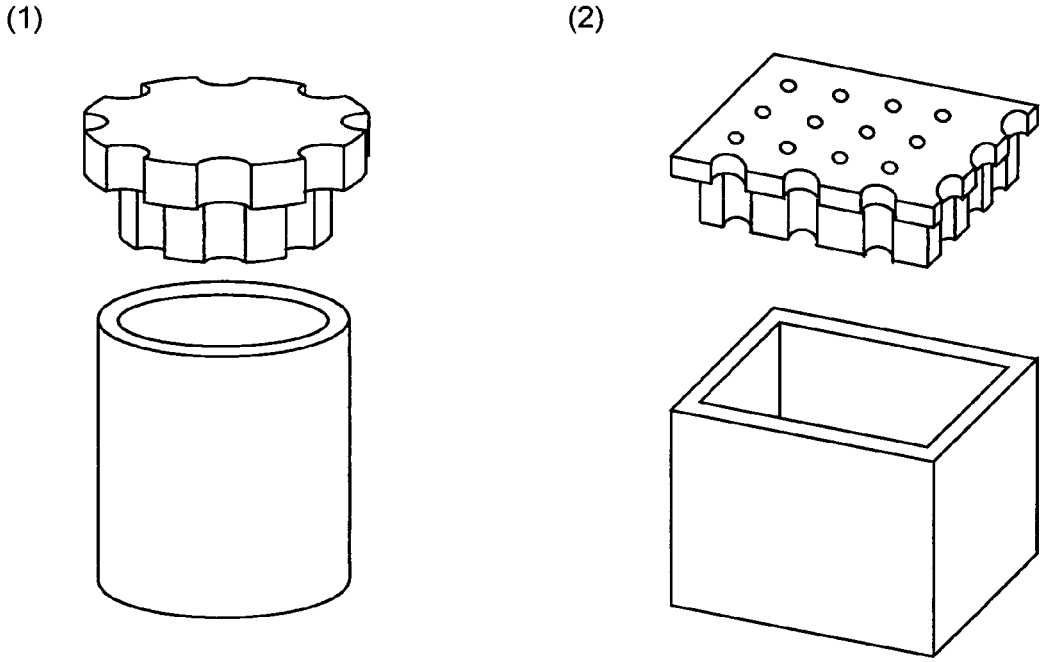
FIG. 4 is a perspective view of examples of the cover for a mold used in the present embodiment.

The cover is designed to loosely fit into the mold. Too tight fitting of the cover into the mold would close the cavity in an airtight manner. Such an airtight state would prevent the sintered body from reaching a high density during the sintering process. Furthermore, the magnetic characteristics would deteriorate due to contamination by the carbon component contained in the lubricant or other additives. To avoid these problems, the fitting is adjusted so that a small gap is present between the cover and the mold. It is also possible to create a small hole for discharging the air, as shown in FIG. 4 (1) or (2).

[Rare-Earth Magnet]

The present invention is applied to a method for manufacturing rare-earth magnets containing R (which is at least one kind of rare-earth elements including Y) and a transition element.

The present invention puts no restrictions on the composition of the rare-earth magnet; any magnet that contains a rare-earth element and a transition element can be manufactured. However, the present invention is particularly suitable for the production of sintered RFeB magnets or sintered RCo magnets.

In most cases, an RFeB rare-earth magnet should preferably contain 27 to 38 weight percent of R, 51 to 72 weight percent of Fe, and 0.5 to 4.5 weight percent of B. If the R content is too low, an iron-rich phase will precipitate, which will weaken the coercive force. Too high a content of R will lower the residual magnetic flux density.

Examples of R are Y, La, Ce, Pr, Nd, Eu, Gd, Tb, DY, Ho, Tm, Yb and Lu, where Nd and/or Pr is a particularly preferable element to include in R. Replacing a portion of R with dysprosium (Dy), terbium (Tb) or other heavy rare-earth elements results in a high coercive force. However, using too much of a heavy rare-earth element for replacement will reduce the residual magnetic flux density. Therefore, the amount of replacement with the heavy rare-earth element should be preferably 6 weight percent or smaller. Too low a B content weakens the coercive force, while too high a B content lowers the residual magnetic flux density. A portion of Fe may be replaced with Co. In that case, the Co content should be preferably 30 weight percent or lower because too much replacement will decrease the coercive force.

To further improve the coercive force and the sinterability, it is possible to add Al, Cu, Nd, Cr, Mn, Mg, Si, C, Sn, W, V, Zr, Ti, Mo, Ga and/or other elements. The total amount of these additives is preferably 5 weight percent or lower because adding too much additives will lower the residual magnetic flux density.

In addition to the aforementioned elements, the magnet alloy may further contain impurities unavoidable during the manufacturing process or a very small amount of other additives, e.g. carbon or oxygen.

A magnet alloy, which has the composition described thus far, has a main phase whose crystal structure is substantially tetragonal. Also, it usually contains about 0.1 to 10 percent by volume of a nonmagnetic phase.

The present invention puts no restrictions on the method for producing the magnet alloy. Typically, it is produced by casting mother alloy ingots and then pulverizing them, or by pulverizing alloy powder obtained by a reduction and diffusion method.

[Powder Grain Size]

The average grain size of the alloy powder should be preferably 0.5 to 5 μm for RFeB magnets. The conventional methods included a step in which a fine powder or a powder compact is exposed to air, so that a fine powder having a grain size of 4 μm or smaller cannot be used. The present invention allows the use of a fine powder having a grain size of 3 μm or smaller, or even 2 μm or smaller, because there is no step in which the powder is exposed to air. To enhance the coercive force, the crystal grain size of the sintered body should be as close to the size of the single-domain particle of the RFeB magnet as possible, i.e. 0.2 to 0.3 μm. To satisfy this requirement, the powder grain size should be as small as possible.

The grain size of a powder was expressed by a value measured with an apparatus named Fisher Sub-Sieve Sizer (F.S.S.S.) (see e.g. Unexamined Japanese Patent Publication S59-163802). Currently, the grain size is generally indicated by $D_{50}$, the median of the grain-size distribution measured with a laser-type grain-size distribution measurement apparatus (produced by Sympatec GmbH, HORIBA, Ltd., etc.). It is known that the latter measurement value is 1.5 to 2 times as large as the former. The present patent application uses $D_{50}$, measured by a laser-type grain-size distribution measurement apparatus.

In the present invention, the crystal grain size for RFeB magnets is 4 μm or smaller in $D_{50}$. To obtain an even higher cohesive force, it should be preferably 3 μm or smaller. In consideration of the fact that the process according to the present invention is carried out within a perfectly closed system, the size can be 2 μm or smaller. To make the crystal grain size close to the single-grain particle size of RFeB intermetallic compounds, the optimal size is 1 μm or smaller.

For RCo magnets, the preferable grain size is from 1 to 5 μm, irrespective of whether the magnet is a 1-5 or 2-17 type.

[Pulsed Magnetic Field]

The powder loaded into the mold orients when a necessary magnetic field is applied to it. The magnetic field should be as strong as possible. In the case of an electromagnet having an iron core, which is used in the die-pressing method, the magnetic field cannot exceed 2.5 T, where the iron core magnetically saturates. Although there is a proposal for the use of a strong, pulsed magnetic field in the die-pressing method, this idea is impractical because it causes a temperature rise due to a hysteresis loss or an eddy-current loss and also gives the precisely designed pressing machine a strong impact, which shortens the life of the die. In contrast, the present invention uses an air-coil located within a continuous system and applies a pulsed magnetic field to the mold filled with the powder. For the present invention, it is unnecessary to perform demagnetization, which is necessary for the die-pressing, CIP or PIR method in order to handle the powder compact.

The magnetic field for orientation should be preferably as strong as possible. In practice, there is an upper limit due to the limited output of the power supply, the coil strength, the frequency of continuous usage and so on. In view of these conditions, a preferable range is 2 T or higher, more preferably 3 T or higher, and a still more preferable range is 5 T or higher. Such levels of magnetic field can be generated with an air-core coil. If an air-core coil is used to generate a pulsed magnetic field in a die-pressing machine, the coil diameter needs to be larger than the die, which is much larger than its cavity into which the powder is to be loaded. This means that the air-coil must have an inner diameter that is large enough to entirely enclose a large die. In contrast, the air-coil used in the present invention needs only to have an inner diameter that is larger than the mold. In an air-core coil, the magnetic field strength increases as the inner diameter of the coil decreases if the ampere-turn is the same. Thus, by using a coil whose inner diameter is small, the method according to the present invention reduces the load on the power supply or the coil, thereby improving the economic efficiency.

In most cases, after being oriented by the pulsed magnetic field, the fine powder in the mold is not demagnetized but immediately sent to the degreasing process, which precedes the sintering process. Since the present invention can be implemented as a closed process that eliminates any chance of exposure to oxygen, it is desirable to use a continuous treatment furnace as the sintering furnace. In another possible process, the mold is set in a closed container, which in turn is enclosed in a conveying chamber filled with an inert gas, and the mold is moved from the closed container to a sintering bedplate within an inert atmosphere chamber provided in the plenum chamber located before the sintering furnace.

[Before Sintering]

In the plenum chamber, the mold is heated under vacuum or a low-pressure inert gas atmosphere. Any lubricant is removed in this stage, if it is used. In the case of a die-pressing, CIP or RIP method, the lubricant component cannot be easily removed from the powder compact because the powder is firmly compressed. In contrast, the present invention does not compress the powder, so that the lubricant component applied to the surface of the powder particles can easily vaporize through the gap between the mold and the cover or the gas-discharging holes formed in the mold or the cover.

While the powder compact is being sintered, the particles do not combine each other when the temperature is lower than 500 degrees Celsius. However, after the temperature has exceeded the level at which the sintering begins, the powder compact may contract and cause a crack. Particularly, if the object to be sintered is ring shaped and held in a mold throughout the sintering process, its inner circumference may contract and crack. To avoid such a problem, the powder compact may be preliminarily sintered at temperatures higher than 500 degrees Celsius and lower than the temperature at which the contraction begins, until the particles are loosely combined. Then, before the contraction begins, the preliminary sintered body is taken out from the mold and put into another mold that has no core. It is also possible to simply remove the core from the previous mold.

[Manufacturing System]

The manufacturing system according to the present embodiment is described with reference to FIGS. 5 and 6.

Figure 5:
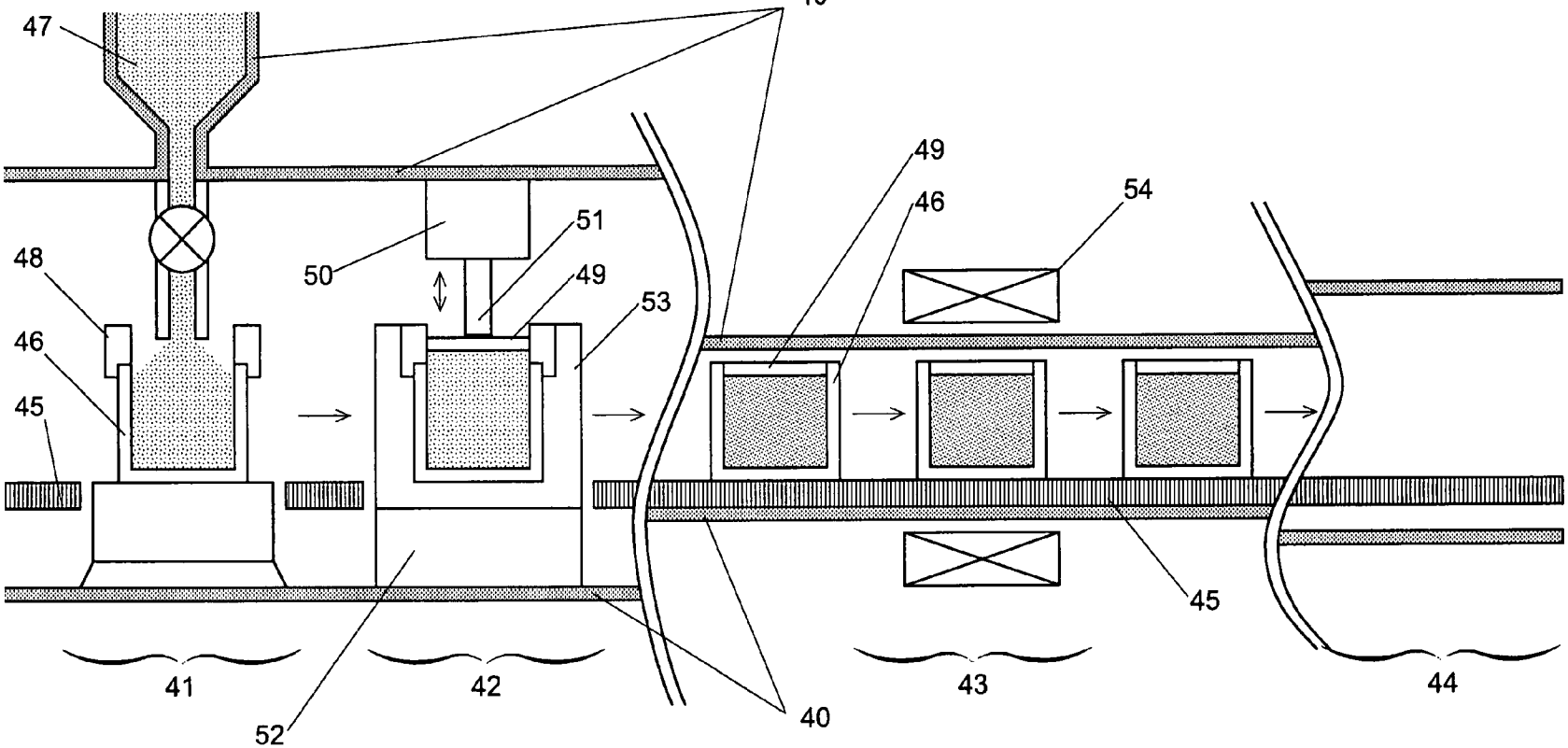
FIG. 5 is a schematic diagram of an example of the system for manufacturing a sintered rare-earth magnet having a magnetic anisotropy according to the present invention.
Figure 6:
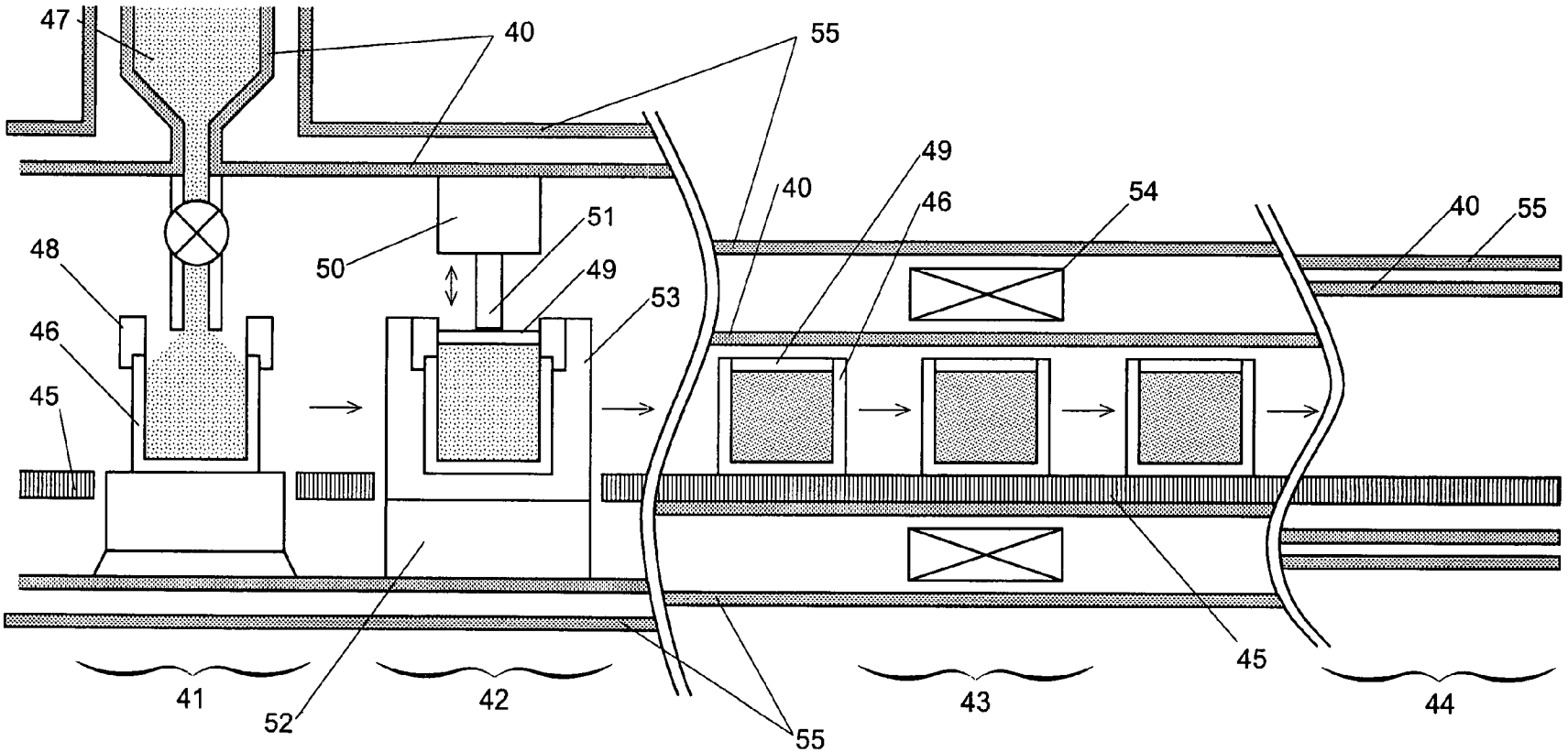
FIG. 6 is a schematic diagram of another example of the system for manufacturing a sintered rare-earth magnet having a magnetic anisotropy according to the present invention.

As shown in FIG. 5, the entire system is surrounded by a wall 40 and filled with an inert gas, such as Ar or $N_2$ gas. This system consists of a powder weighing and loading section 41, a high-density loading section 42 employing a tapping technique, a magnetic orientation section 43 and a sintering furnace 44, with a conveyer 45 linking these sections. The conveyer 45 intermittently conveys a mold 46 filled with a powder, on which a predetermined process is carried out in each section.

In the weighing and loading section 41, a hopper 47 provided with an exciter supplies the powder into the mold 46 at a constant rate. Since the powder-loading density at this stage is approximately as low as its natural loading density, the mold 46 is provided with a guide 48 attached to its upper end so that a predetermined amount of the powder is held in the mold 46.

In the high-density loading section 42, a cover 49 is set on the top of the powder in the upper portion of the mold 46. Then, as shown in FIG. 5, with the cover 49 being pressed with the push rod 51 of the pressure cylinder 50, the tapping machine 52 under the mold 46 is energized to increase the powder density. The present tapping machine is an exciter for intermittently applying (or "tapping") a downward acceleration to the powder in the mold 46. As a result of this tapping operation, the powder in the mold 46 is pressed down to the level equal to or lower than the upper end of the mold 46 (or lower end of the guide) until the cover 49 is fitted into the top of the mold 46. Subsequently, the holder 53 and the guide 48 used for the tapping operation are removed from the mold 46, and the covered mold containing the powder with high density is conveyed to the magnetic orientation section by the conveyer.

In the magnetic orientation section 43, the mold 46 filled with the powder is directed in a predetermined direction and set at a predetermined position (i.e. at the center of the coil). Then, a pulsed high current is supplied to the coil 54 located outside of the wall 40 in order to generate a pulsed magnetic field, which causes the powder in the mold 46 to orient in a predetermined direction. After the powder is oriented, the mold 46 filled with the powder is conveyed into the sintering furnace.

The present system is characterized in the following points: Since the powder is conveyed in the state of being held in the mold, the handling (i.e. handing over and conveying) of the powder is easy and there is no need to use a robot that can perform complex operations or to manually operate the system. Also, since there is no need to use a large-scale pressing machine for applying a total pressure of 10 to 200 tons as in the case of the die-pressing, it is easier to fully surround the entire system with the wall 40, as emphasized in FIG. 5. Security is a very important factor for the present invention because this invention is aiming to ultimately realize a process that can achieve a grain size of $D_{50}$=1 to 2 μm. In that case, even a hole or crack in the wall may cause a huge explosion of the entire system. Therefore, in the present invention, it is possible to surround the wall 40 shown in FIG. 5 with an outer wall 55, as shown in FIG. 6. This construction provides double safety measures. The space between the outer and inner walls should be also filled with the inert gas. By this construction, even if the inner wall is broken during some process, the outer wall will prevent the intrusion of air. Therefore, there is no danger of burning or explosion. Thus, the system will be fail-safe.

Experiments carried out according to the present embodiment are explained below.

First Experiment

An alloy containing, in weight percent, 31.5% of Nd, 0.97% of B, 0.92% of Co, 0.10% of Cu and 0.26% of Al with the remaining percentage being Fe was prepared by a strip-casting method. This alloy was crushed into flakes of 5 to 10 mm in size, which were subjected to hydrogen pulverization and jet-milling processes to obtain a fine powder having a grain size of $D_{50}$=4.9 μm. The above processes were performed under atmosphere with an oxygen concentration of not more than 0.1% in order to reduce the amount of oxygen in the fine powder to the lowest possible level. After the jet-mill pulverization, a liquid lubricant of methyl caproate was added to the powder by 0.5 weight percent, and the mixture was stirred by a mixer.

The powder was loaded into stainless pipes each having an inner diameter of 10 mm, an outer diameter of 12 mm and a length of 30 mm, with powder-loading density of 3.0, 3.2, 3.4, 3.6, 3.8 and 4.0 g/cm$^3$, respectively. Then, a stainless cover was attached to each end of each pipe. To this NdFeB magnet powder loaded in the stainless pipe, a pulsed magnetic field was applied in the direction parallel to the axis of the pipe. The peak value of the pulsed magnetic field strength was 8 T. Two kinds of pulsed magnetic field were used: a damped alternating field, called "AC pulse" hereinafter, which alternately changes its direction while gradually decreasing in strength; and a pulsed magnetic field, called the "DC pulse" hereinafter, which once reaches the peak value of 8 T and then decreases in strength without changing its magnetic direction. In the present embodiment, a pulsed magnetic field consisting of AC, DC and DC pulses in this order, each pulse being 8 T at its peak, was applied to the magnet powder loaded in the stainless pipes. After the application of the magnetic field, the stainless pipes filled with the magnet powder were conveyed into a sintering furnace, whereby they were sintered at a temperature of 1050 degrees Celsius for one hour. In this experiment, the steps of loading the powder into the stainless pipes, orienting the powder by the pulsed magnetic field, conveying it into the sintering furnace, and all the conveying operations between these steps were performed under inert atmosphere. Thus, the entire process from the pulverization through the sintering was carried out without exposing the magnet powder to air. After the sintering process was finished, the sintered bodies were taken out from the stainless pipes. The sintered bodies that had been prepared with the powder-loading densities of 3.0 g/cm$^3$ and 3.2 g/cm$^3$ had many void-like cavities inside. The sintered body prepared with the powder-loading density of 3.4 g/cm$^3$ had no cavity except for a small portion that had been in contact with the cover. The sintered bodies prepared with the powder-loading densities of 3.6 g/cm$^3$ or higher proved to have high density and quality; their density reached 98.7% of their theoretical density, and they had few or no void inside. Next, a cylindrical sample of 7 mm in diameter and 7 mm in height was created from each sintered body. A pulsed magnetic field having the maximum strength of 10 T was applied to each sample, and a magnetic measurement was performed. From the results of the magnetic measurement by the application of the pulsed magnetic field, the ratio of the remnant magnetization to the magnetization value at 10 T was calculated, and the degree of orientation within the sintered body was measured. The results were that the degree of orientation of the sintered body prepared at the loading density of 3.6 g/cm$^3$ was 97.0% and that of the product prepared at 3.8 g/cm$^3$ was 96.0%. For comparison, the degree of orientation of a sintered body prepared by a conventional die-pressing method in a magnetic field was also measured, which was 95.6%.

Second Experiment

This experiment focused on the dependency of the shape and density of the sintered body on the mold material (or saturation magnetization $J_s$). The same alloy as used in the first experiment was subjected to hydrogen pulverization and jet-milling processes to obtain two kinds of fine powders having grain sizes of $D_{50}$=4.9 μm and $D_{50}$=2.9 μm, respectively. The mold cavity into which the powder was to be loaded was shaped like a short cylinder of 25 mm in diameter and 7 mm in thickness. The molds were created from different materials: iron ($J_s$=2.15 T), permalloy ($J_s$=1.4 T, 1.35 T, 0.73 T, 0.65 T and 0.50 T), and nonmagnetic stainless steel. All of these molds had a wall thickness of 1 mm.

The powder was loaded into the cavity of each mold with a loading density of 3.8 g/cm$^3$. The same pulsed magnetic field as used in the first experiment, consisting of the AC, DC and DC pulses, each pulse having a peak value of 8 T, was applied to the powder held in each mold to orient the powder. Then, the powder was sintered. As in the first experiment, the present experiment was conducted so that the sintered bodies were created without allowing the powder to be in contact with air throughout the entire process. The sintering condition was 1050 degrees Celsius for the powder of $D_{50}$=4.9 μm and 1020 degrees Celsius for the powder of $D_{50}$=2.9 μm. After the sintering process was finished, the sintered bodies were taken out from the molds. The result was that the shape of the sintered body significantly changes depending on the mold material. The sintered body created with the iron mold, which had the largest value of $J_s$, had a large hole of about 2 mm in diameter at its center. This hole later became even larger when a cylindrical piece having a diameter of about 0.5 mm came off the circumference of the hole.

Similar tendency was discerned in the cases where permalloy having a $J_s$ value of 1.35 T or higher was used as the mold material, although it was not so eminent as in the case of the iron mold. The mold made of nonmagnetic stainless steel also sometimes had small voids created at the center of the sintered body. However, most of the voids in this case were not very serious and the sintered body was good enough for practical use. The sintered bodies that were well shaped with no defects were those created with the permalloy molds of $J_s$=0.5 to 0.73 T. Particularly, the sintered body created with the permalloy mold of $J_s$=0.73 T was perfectly free from defects and best shaped. These results show that a material whose $J_s$ value is neither too large nor too small, specifically from 0.3 to 1 T, more preferably from 0.5 to 0.8 T, is the most suitable as the material of the mold for holding the powder in the present invention. The optimal $J_s$ value also depends on the powder-loading density and the magnetization of the powder. The experiment showed that the sintered body having the highest quality was obtained when the $J_s$ value of the mold material was close to the powder magnetization multiplied by the powder-loading density expressed in percentage.

It also demonstrated that the quality difference among the sintered bodies due to the mold material depends on the shape of the cavity and will be particularly remarkable in a sintered body whose shape after the sintering process is flat.

Third Experiment

The same strip-cast alloy as used in the first experiment was pulverized with hydrogen and then subjected to a jet-milling process under various pulverization conditions to prepare three kinds of fine powders having different grain sizes: $D_{50}$=2.91 μm, 4.93 μm and 9.34 μm. These powders were loaded into permalloy molds ($J_s$=0.73 T) having the same shape as in the second experiment with a loading density of 3.8 g/cm$^3$, and then they were sintered. Again, the entire process from the pulverization to the sintering was carried out under high-purity Ar atmosphere in order to prevent the powder from being in contact with air. For comparison, sintered bodies were prepared by a conventional die-pressing method. Also in this conventional method, the entire process was carried out under inert atmosphere in order to prevent the powder and powder compacts from being in contact with air before the sintering process. The sintering temperature was 1020 degrees Celsius for $D_{50}$=2.91 μm, 1050 degrees Celsius for $D_{50}$=4.93 μm and 1100 degrees Celsius for $D_{50}$=9.34 μm; these temperature conditions were also applied to both the method according to the present embodiment and the conventional die-pressing method. At these temperatures, the resultant sintered bodies had good quality and no abnormal grain growth took place. After the sintering process, all of these sintered bodies were heat treated at 500 degrees Celsius for one hour. Table 1 shows the coercive force measured by the pulse magnetization measurement method explained in the first experiment and the oxygen content of the sintered bodies. For comparison, Table 2 shows the coercive force and the oxygen content of the sintered bodies created by the conventional die-pressing method.

TABLE 1

| Present Embodiment | | |
|---|---|---|
| Grain size $D_{50}$ (μm) | Coercive force (kOe) | Oxygen content (weight %) |
| 2.91 | 14.4 | 0.18 |
| 4.93 | 12.3 | 0.19 |
| 9.34 | 9.2 | 0.18 |

TABLE 2

| Comparative Example | | |
|---|---|---|
| Grain size $D_{50}$ (μm) | Coercive force (kOe) | Oxygen content (weight %) |
| 2.91 | 13.6 | 0.33 |
| 4.93 | 11.6 | 0.28 |
| 9.34 | 9.2 | 0.20 |

Comparing Tables 1 and 2 shows that the coercive force obtained by the method according to the present invention is higher than that obtained by the conventional method if a powder having a small grain size is used. This is due to the relatively low degree of oxidization of the powder through the process according to the present invention, as can be understood from the two tables. It should be noted that the comparative experiment using the powder of $D_{50}$=2.91 μm encountered an accident in which the powder was heated and started to burn due to a slight air leakage through the housing surrounding the pressing machine. In general, a system employing a conventional die-pressing method is easy to generate heat due to a friction between the powder compact and the die when the powder compact is taken out from the die. Furthermore, it easily occurs that oxygen intrudes from the outside into the system due to various problems inherent in the pressing machine or other problems that accidentally occur in the course of taking out, arranging and boxing up the powder compact. Thus, even if the entire system is designed to operate under Ar atmosphere, the amount of oxygen in the sintered body tends to be large. If the oxygen amount exceeds a certain limit, the powder will be heated and may cause burning, explosion or similar accidents. In contrast, the process according to the present invention is so simple that it will encounter few problems and suppress the intrusion of oxygen into the system to a very low level. Since this state is stable, the amount of oxygen in the sintered body will be very low even if the powder has a small the grain size. Thus, it is possible to constantly produce low oxygen sintered bodies. Although the difference between Tables 1 and 2 is based on the comparison of only a few examples, it is expected that the effect of the present invention will be more remarkable than the difference between the two tables if a large number of products are manufactured on a mass production basis.

The present embodiment has demonstrated that the powder of $D_{50}$=2.91 μm can be used as a reliable material for the production of sintered NdFeB magnets, and that the method according to the present invention can increase the coercive force without using an expensive rare-earth element, such as Dy and Tb.

Fourth Experiment

Figure 7:
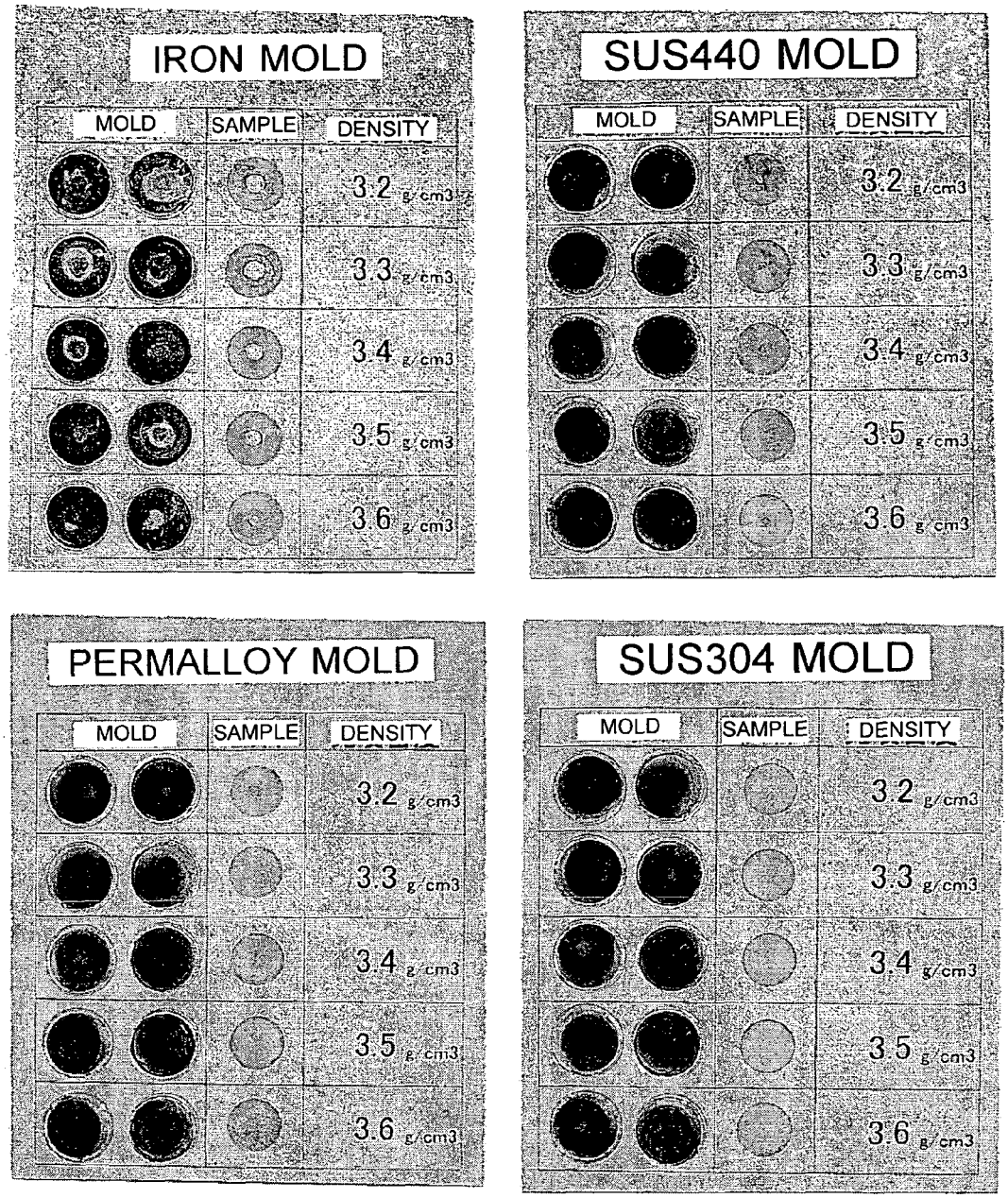
FIG. 7 shows photographs of disc-shaped sintered NdFeB magnets created in the present embodiment and the molds that were used for creating those magnets.

The strip-cast alloy created in the first experiment was pulverized with hydrogen and then subjected to a jet-milling process to prepare a powder of $D_{50}$=2.9 μm. Next, 0.5 weight percent of methyl caproate was added to and mixed with the powder. Meanwhile, four types of molds with a cavity of 23 mm in diameter and 4 mm in depth were created from iron, magnetic stainless steel ($J_s$=1.4 T), permalloy ($J_s$=0.7 T) and nonmagnetic stainless steel, respectively. The thickness of the mold was 3 mm at both ends and 2 mm at its side. A mixture of BN powder and a solid wax was rubbed against the inner surface of each mold to form a film for preventing adhesion of the powder during the sintering process. Into these molds, the aforementioned powder of $D_{50}$=2.9 μm with methyl caproate added to it was loaded, with loading densities of 3.2 g/cm$^3$, 3.3 g/cm$^3$, 3.4 g/cm$^3$, 3.5 g/cm$^3$ and 3.6 g/cm$^3$, respectively. These molds containing the powder were then put into a coil, with which a magnetic field consisting of AC, DC and DC pulses in this order, each pulse having a peak value of 9 T, was applied in the direction parallel to the axis of the cylindrical molds in order to orient the powder. Subsequently, the powder was sintered under vacuum at 1010 degrees Celsius for two hours, and then cooled. FIG. 7 shows photographs of the inside of the molds and the sintered bodies, taken after the sintering process. The molds were 19.0 to 19.5 mm in diameter and 2.7 to 2.8 mm in thickness (a mold becomes larger as the loading density increases). These photographs show that all the sintered bodies created with the iron molds have a hole at their center and fragments of the sintered body are remaining at the center of the mold. Thus, if a relatively thin sintered body is created with an iron mold, the resultant sintered body will have a large hole at its center even if the powder-loading density is high. The photographs also suggest that use of a magnetic stainless steel (SUS440) mold also tends to result in a void at the center of the disc-shaped sintered body if the loading density is low. In contrast, the sintered bodies created with the permalloy molds and the nonmagnetic stainless steel (SUS304) molds do not have a void at their center even if the loading density is low (3.2 to 3.3 g/cm$^3$). It should be noted that each of the molds used in this experiment was loosely closed with a cover; that is, the mold and the cover were not tightly pressed onto each other at their interface. During the sintering process, the gas components released from the powder escaped from the mold through the loose interface.

Fifth Experiment

Using the same powder as used in the fourth experiment, an experiment similar to the fourth was carried out using molds having a cavity of 10 mm in diameter and 60 mm in length. A cover was fitted into one end of each of the cylindrical molds to form a cavity, into which the powder was loaded with loading densities of 3.4 g/cm$^3$, 3.5 g/cm$^3$, 3.6 g/cm$^3$, 3.7 g/cm$^3$ and 3.8 g/cm$^3$, respectively. This experiment also examined the effect of independently changing the material of both covers and that of the mold. After the powder was loaded and both covers were attached to the molds, an orienting magnetic field was generated in the axial direction of the cylindrical molds under the same conditions as in the fourth experiment. Subsequently, a sintering process was performed as in the fourth experiment. The covers were loosely fit into both ends of the molds so that the gas released during the sintering process could easily escape. The sintering condition was the same as in the fourth experiment. An examination of the sintered bodies concerning the density and the shape and presence of voids showed that any of the above samples had become a defect-less, long and cylindrical sintered body having a density of 7.5 g/cm$^3$ or higher. However, in the case where the covers were made of nonmagnetic SUS304, the cylindrical sintered body was deformed; it was thicker at the center and thinner at both ends, like a barrel. In the case where both ends were made of a ferromagnetic material, the resultant cylindrical sample was uniform in its thickness.

Sixth Experiment

Using the same powder as used in the fourth experiment, an experiment was carried out in which plate magnets and arched plate magnets were manufactured using the mold shown in FIG. 2 (3). When the arched plate magnets was manufactured, the partitions 21 of the mold were replaced with arched ones. Before the loading of the powder, a mixture of BN and a solid wax was rubbed against the mold to form a coating film. The upper and lower covers consisted of a nonmagnetic stainless steel plate of 1 mm in thickness. Each of the two covers was fixed to each end of the mold body by screws inserted through the holes at the four corners of the cover into the threaded holes (not shown in FIG. 2 (3)) prepared at the four corners of the mold. The powder-loading density was varied from 3.2 g/cm$^3$ to 3.9 g/cm$^3$ in steps of 0.1 g/cm$^3$. The sintering condition was the same as in the fourth experiment. The orienting direction of the magnetic field was parallel to the longer side of the outer frame of the mold. The results of this experiment are summarized as follows:

(1) When the loading density was 3.4 g/cm$^3$ or higher and the mold and the partitions were made of a nonmagnetic material or permalloy, the resultant plate type and arched plate type sintered NdFeB magnets were free from defects and had a high density and high magnetic characteristics.

(2) When the flat or arched partitions were made of iron or magnetic stainless steel, it was impossible to create a product having good qualities; they had a void at their center, similar to the voids shown in the photographs of the fourth experiment (FIG. 7).

(3) A mold was prepared with its outer frame made of iron, magnetic stainless steel or permalloy, its upper cover and bottom plate made of nonmagnetic stainless steel, and its partitions made of nonmagnetic stainless steel or permalloy. After the powder was loaded into the mold, both covers were attached and a pulsed magnetic field was generated to orient the powder. Then, the cover and the bottom plate, all made of nonmagnetic stainless steel, were removed from the upper and lower ends of the mold. The powder oriented in the mold neither fluffed nor fell off the mold, maintaining the stable state even when it received a slight mechanical vibration or shock. Subsequently, the powder was sintered without the cover and the bottom plate. The resultant sintered bodies had good qualities with high degree of orientation and high sintered density. However, when the outer frame of the mold was made of iron or magnetic stainless steel, there were voids in those sintered bodies which were created in the cavities located at both ends of the multiple cavities separated by the partitions, i.e. those created in the cavities whose flat or arched surfaces were in contact with the outer frame. The other sintered magnets created in the other cavities had good qualities without any void formed in them.

Seventh Experiment

Using the same powder as used in the fourth experiment, a ring-shaped tubular magnet having an orienting direction parallel to its axis was created. The mold used in this experiment had a hole at the center of each of the upper and lower covers, into which a core was to be inserted. The lower cover, having the core fitted into its hole, was attached to the mold to form a ring-shaped tubular cavity. This cavity was filled with an alloy powder with a loading density of 3.4 to 3.8 g/cm$^3$ and the upper cover was closed. The fittings between the core and the two covers and between the mold and the two covers were adjusted so that those components would not fall apart when the mold was lifted but would be separated when they were strongly pulled. The material of each of the two covers, the core and the mold was independently changed among the same four kinds of materials as used in the fourth experiment.

Figure 8:
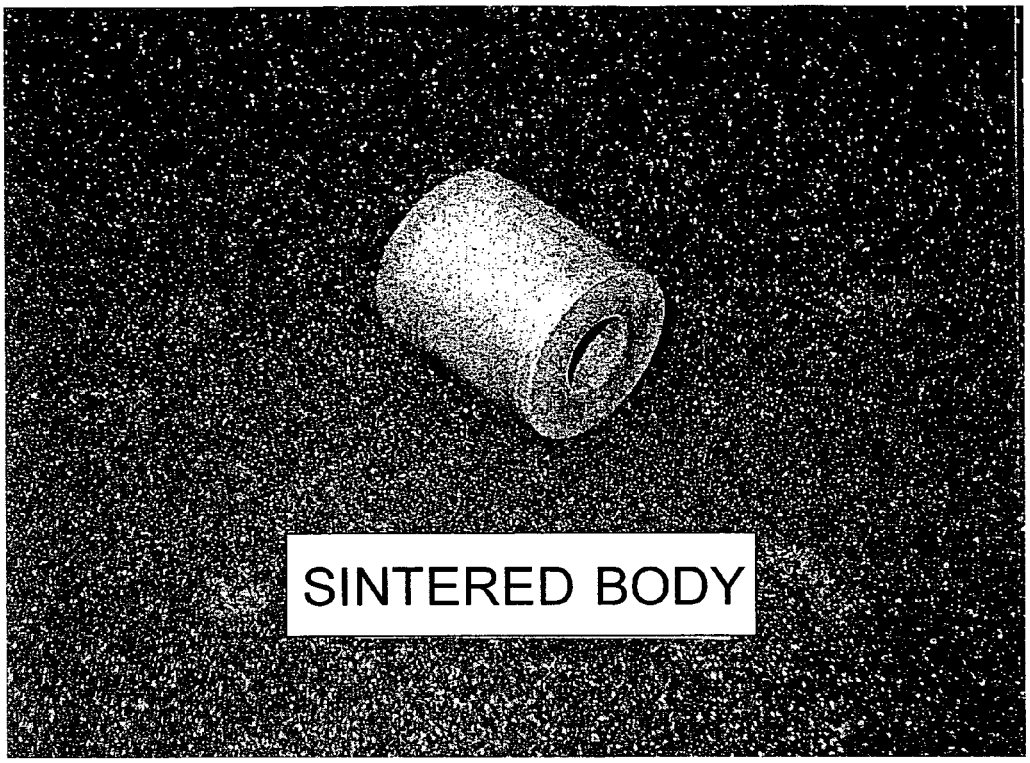
FIG. 8 shows photographs of a ring-shaped tubular sintered NdFeB magnet and the mold used for creating that magnet.
Figure 8:
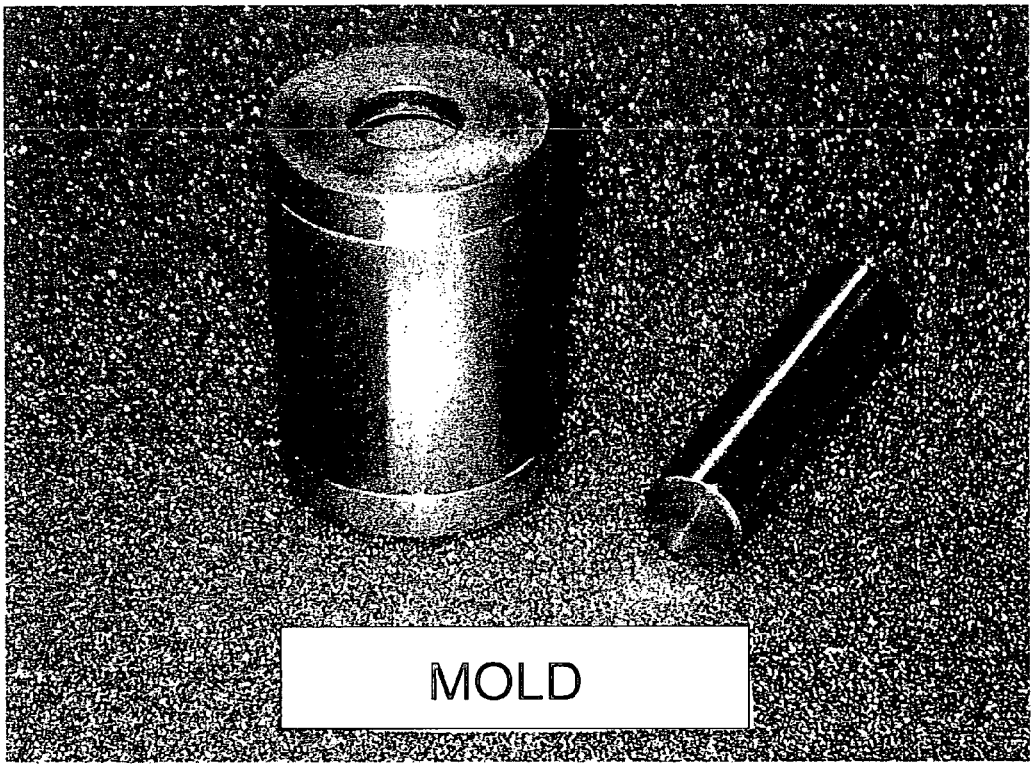

After the powder was loaded into the ring-shaped tubular cavity and a magnetic field was applied in the direction parallel to the axis of the cavity, the core was removed. At that moment, the magnetized powder did not stick to the upper and lower covers and fall off or collapse in the case where the core was made of nonmagnetic stainless steel and the two covers were made of a magnetic material (iron, magnetic stainless steel or permalloy). Subsequently, the mold containing the powder without the core was set in a sintering furnace, with the axis of its cylindrical body vertically directed, and the powder was sintered at 1010 degrees Celsius for two hours. The sintered body thereby created was neither deformed nor distorted, having the ring-shaped tubular form as calculated back from the contraction due to the sintering. No defect, such as a void, was present and the sintered density was high. A measurement of the magnetic characteristics proved that the sintered, ring-shaped tubular NdFeB magnet has much higher $B_r$ and $(BH)_{max}$ values than the sintered NdFeB magnets created by a conventional method that applies a pressure in the direction parallel to the magnetic field (or die-pressing method), and the aforementioned values can be as high as the characteristics of magnets created by applying a pressure perpendicular to the magnetic field, or even higher than those under some conditions. FIG. 8 shows photographs of the molds used in the present experiment and the sintered, ring-shaped tubular NdFeB magnets created using those molds. In this experiment, the mold cavity was 23.0 mm in outer diameter, 10.0 mm in inner diameter and 33.2 mm in height. The ring-shaped tubular magnet was 19.1 mm in outer diameter, 8.6 mm in inner diameter and 22.3 mm in height.

Eighth Experiment

Five samples of alloys differing in composition and thickness as shown in Table 3 were prepared.

TABLE 3

| Alloy No. | Average Thickness of Alloy (mm) | Composition (wt %) | | | | | | |
|---|---|---|---|---|---|---|---|---|
| | | Nd | Dy | B | Co | Cu | Al | Fe |
| 1 | 0.27 | 30.8 | 0.0 | 1.0 | 0.9 | 0.1 | 0.2 | bal. |
| 2 | 0.20 | 30.7 | 0.0 | 1.0 | 0.9 | 0.1 | 0.2 | bal. |
| 3 | 0.15 | 30.8 | 0.0 | 1.0 | 0.9 | 0.1 | 0.2 | bal. |
| 4 | 0.11 | 30.9 | 0.0 | 1.0 | 0.9 | 0.1 | 0.2 | bal. |
| 5 | 0.22 | 27.8 | 3.0 | 1.0 | 0.9 | 0.1 | 0.2 | bal. |

These alloys were made to occlude hydrogen to create fine cracks in them. Then, the alloys were heated to 400 degrees Celsius to remove the hydrogen contained in their main phase. Next, the hydrogen-pulverized alloys were further pulverized into fine powder by a jet mill. By varying the pulverizing conditions of the jet mill, powders having grain sizes of 4 μm or smaller were prepared. Before the jet-mill pulverization, a solid lubricant of a zinc stearate powder was added to the hydrogen-pulverized alloy by 0.05% of the weight of the alloy. Being kept from air, these powders were conveyed into a high-performance glove box (dew point: about −80 degrees Celsius) filled with high purity Ar gas. After this step, all the operations on the powders were carried out in this glove box. First, a liquid lubricant of methyl caproate was added to each of the alloy powders by 0.5%. Then, the powders were stirred for five minutes with a mixer having a blade revolving at high speed. The stirred powders were loaded into permalloy molds each having a cylindrical cavity of 10 mm in diameter and 10 mm in depth. The loading density was varied from 2.5 g/cm$^3$ to 4.1 g/cm$^3$ in steps of 0.1 g/cm$^3$. After the powders were loaded, the molds were covered. The cover had neither a hole nor a groove; instead, a gap was formed between the cover and the mouth of the mold as a gas-discharging passage. The molds filled with powders were put into a container, and a pulsed magnetic field was applied to the powders and the molds while they were enclosed in the container. The pulsed magnetic field was varied within a range of 1.8 T to 9 T, and a damped alternating pulse and a direct-current pulse were sequentially applied to magnetically orient the powders. After the powders were magnetically oriented, the container was connected to the entrance of a sintering furnace. Then, without contact with air, the molds were transferred from the container into the sintering furnace. After the entrance of the sintering furnace was closed, the powders were sintered in a high vacuum of $10^{-4}$ Pa or higher. The sintering temperature was varied within a range of 950 to 1050 degrees Celsius, where the temperature at which the sintered density (i.e. the density of the sintered body) exceeded 7.5 g/cm$^3$ was defined as the optimal temperature. The sintering process was continued for two hours. After the sintering process, the sintered bodies were quenched from 800 degrees Celsius to the room temperature. Subsequently, the sintered bodies were heated at 500 to 600 degrees Celsius for one hour and then quenched. After this heat treatment, a cylindrical body of 7 mm in diameter and 7 mm in length was created from each sample of the sintered bodies, and the cylindrical bodies were subjected to visual checking, density measurement and magnetization curve measurement by a pulse magnetization measurement using a pulsed magnetic field having the maximum strength of 10 T. Table 4 shows the main results of this experiment.

TABLE 4

| Sample No. | Alloy No. | Grain size $D_{50}$ (μm) | Density (g/cm$^3$) | Orienting field (T) | Sintering temp.(° C.) | $B_r$ (T) | $(BH)_{max}$ (MGOe) | $H_{cJ}$ (kOe) | $J_r/J_s$ (%) | Note |
|---|---|---|---|---|---|---|---|---|---|---|
| 1 | 2 | 2.9 | 3.3 | 9.0P | 1010 | 1.46 | 50.8 | 14.9 | 96.5 | |
| 2 | 2 | 2.9 | 3.5 | 9.0P | 1010 | 1.47 | 51.1 | 14.8 | 96.6 | |
| 3 | 3 | 2.1 | 3.5 | 9.0P | 1000 | 1.47 | 51.2 | 15.9 | 96.7 | |
| 4 | 3 | 1.6 | 3.6 | 9.0P | 990 | 1.47 | 51.3 | 17.0 | 96.6 | |
| 5 | 2 | 2.9 | 3.6 | 5.0P | 1010 | 1.45 | 51.3 | 14.8 | 95.2 | |
| 6 | 2 | 2.9 | 3.7 | 5.0P | 1010 | 1.45 | 49.9 | 15.0 | 95.6 | |
| 7 | 2 | 2.9 | 3.8 | 9.0P | 1010 | 1.45 | 49.6 | 14.8 | 95.3 | |
| 8 | 2 | 2.9 | 3.9 | 9.0P | 1010 | 1.43 | 48.1 | 15.1 | 93.9 | |
| 9 | 4 | 1.6 | 3.6 | 9.0P | 990 | 1.46 | 51.2 | 17.5 | 96.5 | |
| 10 | 5 | 2.8 | 3.6 | 8.0P | 1010 | 1.39 | 45.1 | 20.3 | 96.0 | |
| 11 | 2 | 1.6 | 3.6 | 9.0P | 990 | 1.48 | 51.3 | 16.2 | 96.8 | |
| 12 | 1 | 1.6 | 3.6 | 9.0P | 990 | 1.48 | 51.4 | 15.7 | 96.7 | |
| 13 | 2 | 2.9 | 3.0 | 2.5D | 1010 | 1.41 | 47.4 | 14.9 | 93.0 | |
| 14 | 2 | 2.9 | 3.5 | 9.0P | 1050 | 1.43 | 45.1 | 10.8 | 95.0 | |
| 15 | 3 | 1.6 | 3.6 | 9.0P | 1040 | 1.40 | 43.2 | 9.8 | 94.8 | |
| 16 | 2 | 2.9 | 3.6 | 1.8P | 1010 | 1.31 | 38.8 | 14.8 | 87.4 | |
| 17 | 2 | 2.9 | 2.5 | 9.0P | 1020 | — | — | — | — | Void found. |
| Comparative example | 1 | 4.9 | — | 2.0P | 1050 | 1.41 | 47.4 | 11.7 | 94.8 | Die-pressing |

In Table 4, the values 9.0 P and 1.8 P in the "Field strength" column indicate the use of a pulsed magnetic field having a peak value of 9.0 T or 1.8 T, respectively; in each case, one pulsed magnetic field consisted of a damped alternating pulse having the specified peak value, followed by two cycles of direct-current pulses applied in the same direction with the same peak value. The value 2.5 T indicates that a direct-current magnetic field of 2.5 T was applied. More specifically, the direct-current magnetic field was initially applied in one direction and then, without changing the position of the molds, the applying direction of the direct-current magnetic field was reversed while maintaining the same field strength.

The present experiment has demonstrated that the method according to the present invention can safely handle very fine powders that were difficult to handle by conventional methods, such as die-pressing or RIP, and that the present invention makes it possible to industrially manufacture a sintered NdFeB magnet having a high coercive force that was hard to achieve by the conventional methods.

To obtain such high characteristics, it is desirable to appropriately set the density of the powder loaded in the mold, the orienting field strength, the sintering temperature and other parameters. Samples Nos. 1 to 13 each have high values of residual magnetic flux density $B_r$, maximum energy product $(BH)_{max}$, coercive force $H_{cj}$ and degree of orientation $J_r/J_s$. In contrast, samples Nos. 14 and 15, which were sintered at higher temperatures, have somewhat lower $(BH)_{max}$ and $H_{cj}$ values than the other samples. Sample No. 16, for which the orienting magnetic field was set lower, is lower in $(BH)_{max}$, $H_{cj}$ and $J_r/J_s$ than the other samples. Sample No. 17, whose loading density was set lower than that of the other samples, had a void in the sintered body, so that the measurement values of its magnetic characteristics were not comparable to those of the other samples.

The comparative example in Table 4 shows the measurement result of a sintered NeFeB magnet created by a conventional die-pressing method using a powder having a standard grain size. Since the grain size was relatively large, the coercive force of the magnet of the comparative example was lower than most of the other magnets created according to the present invention.

The invention claimed is:

1. A method for manufacturing a sintered NdFeB magnet having a magnetic anisotropy, comprising:

a) loading an NdFeB alloy powder into a container (called a mold hereinafter) having a cavity whose form corresponds to that of a product to be obtained with a loading density of the alloy powder being within a range from 47.4 to 55% of a real density, the alloy powder having an average grain size $D_{50}$ of 0.5 to 5 μm measured with a laser grain-size distribution measurement apparatus and containing a total of 6 weight percent or smaller of Dy and/or Tb;

b) applying an orienting magnetic field that is 2 T or higher to the alloy powder in absence of a compression to orient the alloy powder;

c) creating a sintered body by heating the alloy powder contained in the mold in an absence of a compression while allowing gas components released from the alloy powder to escape from the mold; and d) taking out the sintered body of the alloy powder from the mold, wherein the steps a) through c) are performed under vacuum or under an atmosphere of an inert gas.

2. The method according to claim 1, wherein the orienting magnetic field is 3 T or higher.

3. The method according to claim 2, wherein the orienting magnetic field is 5 T or higher.

4. The method according to claim 1, wherein the orienting magnetic field is a pulsed magnetic field.

5. The method according to claim 4, wherein the orienting magnetic field is an alternating magnetic field.

6. The method according to claim 1, wherein the orienting magnetic field is applied multiple times.

7. The method according to claim 6, wherein the orienting magnetic field is a combination of an alternating magnetic field and a direct-current magnetic field.

8. The method according to claim 1, wherein a lubricant is added to the alloy powder.

9. The method according to claim 8, wherein the lubricant consists of either a solid or liquid lubricant or both.

10. The method according to claim 9, wherein a main component of the liquid lubricant is either fatty ester or depolymerized polymer.

11. The method according to claim 1, wherein a grain size of the alloy powder is 4 μm or smaller.

12. The method according to claim 11, wherein the grain size of the alloy powder is 3 μm or smaller.

13. The method according to claim 12, wherein the grain size of the alloy powder is 2 μm or smaller.

14. The method according to claim 13, wherein the grain size of the alloy powder is 1 μm or smaller.

15. The method according to claim 12, wherein the grain size of the alloy powder is 3 μm or smaller and a sintering temperature is 1030 degrees Celsius or lower.

16. The method according to claim 15, wherein the grain size of the alloy powder is 2 μm or smaller and the sintering temperature is 1010 degrees Celsius or lower.

17. The method according to claim 1, wherein a portion or an entirety of the mold is used multiple times.

18. The method according to claim 1, wherein the mold has multiple cavities.

19. The method according to claim 1, wherein the cavity is pillar shaped.

20. The method according to claim 1, wherein a pillar-shaped core is provided at a center of a tubular cavity.

21. The method according to claim 20, wherein, after the alloy powder is loaded into the cavity and the magnetic field is applied to orient the powder, the core is removed from the mold or replaced with a thinner one, after which the powder is sintered.

22. The method according to claim 21, wherein the magnetic field is applied along an axial direction of the cavity to orient the alloy powder.

23. The method according to claim 22, wherein portions corresponding to a cover and a bottom of the cavity at both ends in the axial direction are made of a ferromagnetic material.

24. The method according to claim 18, wherein each cavity is pillar shaped.

25. The method according to claim 18, wherein a pillar-shaped core is provided at a center of a tubular cavity.

26. The method according to claim 25, wherein, after the alloy powder is loaded into the cavity and the magnetic field is applied to orient the powder, the core is removed from the mold or replaced with a thinner one, after which the powder is sintered.

27. The method according to claim 26, wherein the magnetic field is applied along an axial direction of the cavity to orient the alloy powder.

28. The method according to claim 27, wherein portions corresponding to a cover and a bottom of the cavity at both ends in the axial direction are made of a ferromagnetic material.

29. The method according to claim 18, wherein the cavity is plate shaped.

30. The method according to claim 18, wherein the cavity is shaped like an arched plate.

31. The method according to claim 29, wherein the magnetic field is applied along a direction perpendicular to a flat or arched surface of the cavity to orient the alloy powder.

32. The method according to claim 31, wherein the flat or arched surface of the cavity is made of either a nonmagnetic material or a material whose saturation magnetization is 1.5 T or lower.

33. The method according to claim 32, wherein the saturation magnetization is 1.3 T or lower.

34. The method according to claim 30, wherein the magnetic field is applied along a direction perpendicular to a flat or arched surface of the cavity to orient the alloy powder.

35. The method according to claim 34, wherein the flat or arched surface of the cavity is made of either a nonmagnetic material or a material whose saturation magnetization is 1.5 T or lower.

36. The method according to claim 35, wherein the saturation magnetization is 1.3 T or lower.

37. The method according to claim 18, wherein two or more rows of cavities are arranged in the mold.

38. The method according to claim 29, wherein two or more rows of cavities are arranged in the mold.

39. The method according to claim 1, wherein a portion of the mold that forms a wall parallel to the direction of orienting the alloy powder by the magnetic field is partially or entirely made of a ferromagnetic material.

40. The method according to claim 1, wherein an inner wall of the cavity is covered with an anti-burning coating.

41. The method according to claim 1, wherein the alloy powder is forcefully loaded into the mold by one or a combination of two or more of following methods: a mechanical tapping method that employs mechanical vibration, a pressure method that uses a push rod, and an air-tapping method that uses a strong flow of air.

42. The method according to claim 1, wherein the alloy powder is a fine powder obtained by pulverizing an alloy created by quenching a molten metal.

* * * * *